US012577746B1

(12) United States Patent
Johnson

(10) Patent No.: US 12,577,746 B1
(45) Date of Patent: Mar. 17, 2026

(54) MODULAR SEA WALL SYSTEM

(71) Applicant: Shawn Michael Johnson, Rockport, TX (US)

(72) Inventor: Shawn Michael Johnson, Rockport, TX (US)

(73) Assignee: SHORELINE EROSION CONTROL SOLUTIONS, LLC, Kemah, TX (US)

( * ) Notice: Subject to any disclaimer, the term of this patent is extended or adjusted under 35 U.S.C. 154(b) by 190 days.

(21) Appl. No.: 18/366,606

(22) Filed: Aug. 7, 2023

Related U.S. Application Data

(63) Continuation-in-part of application No. 17/459,004, filed on Aug. 27, 2021, now Pat. No. 11,718,969.

(51) Int. Cl.
*E02B 3/06* (2006.01)

(52) U.S. Cl.
CPC ..... *E02B 3/06* (2013.01)

(58) Field of Classification Search
CPC ..... E02B 3/06; E02B 3/16; E02B 3/04; E02B 3/14
See application file for complete search history.

(56) References Cited

U.S. PATENT DOCUMENTS 2,069,715 A * 2/1937 Arpin ..... E02B 3/06 405/25
3,653,216 A * 4/1972 Stickler, Jr. ..... E02B 3/04 405/33
3,733,831 A * 5/1973 Sticker, Jr. ..... E02B 3/04 405/134
4,231,680 A * 11/1980 Ijima ..... E02B 3/06 405/35
5,393,169 A 2/1995 Creter
11,718,969 B1 8/2023 Johnson
2006/0275081 A1* 12/2006 Medina Folgado ..... E02B 3/06 405/15
2008/0240861 A1* 10/2008 Phillips ..... E02B 3/10 405/114
2011/0277395 A1* 11/2011 Wink ..... E01C 11/222 47/33
2017/0342673 A1* 11/2017 O'Sullivan ..... E02B 3/06

OTHER PUBLICATIONS

Notification of Transmittal of the International Search Report and the Written Opinion of the International Searching Authority, or the Declaration mailed Jul. 10, 2025.

* cited by examiner

*Primary Examiner* — Carib A Oquendo
(74) *Attorney, Agent, or Firm* — Schrantz Law Firm, PLLC; Stephen D. Schrantz

(57) ABSTRACT

The modular sea wall forms a sea wall constructed from two different blocking bodies: a front blocking body and a rear blocking body. The front blocking body is located seaward and the rear blocking body is located shoreward. The front blocking body provides a front wall that curves upward to the uppermost surface of the front blocking body. The front blocking body attaches to the rear blocking body at the top of the curve. The rear blocking body provides a rear wall that attaches to the front blocking body. The rear wall may be a vertical wall that extends vertically downward without curving or a curved wall that curves downwards from the attachment point to the rear end of the rear attachment body. The front wall and rear wall may provide openings that allow water to flow through the front wall and the rear wall.

22 Claims, 25 Drawing Sheets

MODULAR SEA WALL SYSTEM

CROSS-REFERENCE TO RELATED APPLICATIONS

This application claims priority to and is a continuation in part of U.S. patent application Ser. No. 17/459,004 filed on Aug. 27, 2021 entitled MODULAR SEA WALL SYSTEM.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

1. Field of the Invention

The present invention relates to a sea wall to reduce the erosion and deterioration of the beach/shoreline by incoming waves. More specifically, the present invention is related to a modular sea wall system installed within the water to reduce the energy of the incoming waves. The modular sea wall system provides a modular system that connects via a tongue and groove connection. The sea wall provides two separate blocking bodies that are constructed from reinforced concrete. Such reinforced concrete may be reinforced with rebar, fiberglass, welded wire mesh, or other reinforced materials.

II. Description of the Known Art

Various types of prior art artificial reef systems have been placed on the ocean floor in the vicinity of the shore to prevent beach erosion. In these known systems a principle purpose is to provide a subsurface breakwater structure for deflecting water currents and thereby reduce the damaging force of the waves as they impact on the beach. Another purpose is to provide a structure that has the characteristics of a natural reef and thus is attractive and protective of fish and aquatic organisms. In the case of a breakwater, waves passing over the subsurface structure break a sufficient distance off shore to reduce the energy carried by the waves as they continue on toward the shore. As a result, the speed is diminished and sand carried by the water is permitted to be deposited on the beach rather than being removed by undertow, i.e., the reverse underwater current caused by receding waves.

Certain problems exist with the known art. Known beach erosion systems do not provide a modular system constructed from two pieces that secure to one another similar to the present invention.

U.S. Pat. No. 5,507,594 entitled "Method and apparatus for constructing an artificial reef" issued to Speicher on Apr. 16, 1996 ("the '594 patent") teaches an apparatus and method for constructing an artificial ocean reef for use below the ocean surface to serve as an offshore breakwater for inbound waves and thereby prevent beach erosion. The reef taught by the '594 patent has a plurality of adjacent sections, each of which comprises an arched wall having a series of side-by-side transverse concrete blocks, and flexible interconnections between the blocks at adjacent lateral edges to provide a generally smooth outer surface. The arched wall sections taught by the '594 patent are each formed above the water surface on a barge or the like and then submerged with a shoreward side having a shoreward end resting on the floor of the ocean and a seaward side with a seaward end resting on the floor of the ocean outwardly from the shoreward end to present the smooth outer surface on the seaward side of the wall to incoming waves. Adjacent sections are secured together to form a continuous barrier aligned with the shore line of the beach being protected.

U.S. Pat. No. 4,958,956 entitled "Submerged flexible wave restraining structure and a method of constructing it" issued on Sep. 25, 1990 to Tanaka ("the '956 patent") teaches a wave reducing structure which reduces waves propagating on liquid surface from propagating over the reducing structure and a method of constructing the wave reducing structure. The wave reducing structure taught by the '956 patent may be used to form a calm water surface region for harbors, for areas where construction work is being done or for areas where marine sports are to be performed etc. The resilient wave reducing structure taught by the '956 patent includes at least one energy absorbing device having a resilient body constructed on a bottom of the liquid bounding the region where waves have to be reduced and filled with surrounding ambient liquid. The '956 patent teaches that this reduces the amplitude of waves passing over it by consuming the wave energy while it deforms according to the pressure distribution change caused by the waves and by radiating its kinetic energy into the liquid and the ground surrounding it. Because the wave reducing structure is resilient and deeply submerged under water, the '956 patent teaches that it does not hinder ships from passing over it. Therefore, the '956 patent teaches that it becomes possible to create a calm region on a liquid surface without hindering a navigation of ships and without creating a danger of wrecking the ships.

U.S. Pat. No. 7,736,089 entitled "System and method for prevention of beach erosion" issued on Jun. 15, 2010 to Brais ("the '089 patent") teaches a system and method for prevention of erosion utilizing a sub-tidal platform designed to be lodged at a beachhead. The sub-tidal platform taught by the '089 patent will be placed under water and will contain at least one or a plurality of main trusses exhibiting a curvilinear convex shape and containing a plurality of gates and at least one or a plurality of intermittent trusses exhibiting a curvilinear convex shape and containing a plurality of gates which, when in their closed position, decelerate material entrained with liquid and allow for deposit of said material in the spaces formed by the trusses.

U.S. Pat. No. 4,923,339 entitled "Foldable concrete retaining wall structure" issued on May 8, 1990 to Smith ("the '339 patent") teaches individual precast concrete wall units for erecting a retaining wall structure each include a face member, a support member, and an anchor member. The support member taught by the '339 patent has a front end portion, that is connected by a hinge to one end of the face member, and a rear end portion, that is connected to one end of the anchor member, either by a tongue-and-slot arrangement or by another hinge. The wall units taught by the '339 patent can be cast straight, thus simplifying the design and reducing the space occupied by the mold. The wall units taught by the '339 patent can also be transported and stored in the straight condition to save space. At the job site, the units taught by the '339 patent are quickly and easily folded into an open bin-like form for placement side-by-side to construct a retaining wall.

US Publication No. 20110236132 entitled "Erosion Control Barrier" issued to Wisegerber on Sep. 29, 2011 ("the '132 publication") teaches the protection of a shoreline from erosion caused by wave action and reclaiming lost land areas by use of one or more barriers having a porosity to allow a portion of the wave to pass through the barrier at a reduced force causing the slower water to release sediment behind the barriers. Further by redirecting and dissipating the full force of waves, the '132 publication teaches that additional damage can be prevented.

Many of the known artificial reefs used as submerged breakwaters to protect against beach erosion comprise structure that is difficult and costly to fabricate, transport and install. For example, in one application a series of prefabricated concrete modules are used, each of which weighs as much as 20 tons. This massive structure not only contributes to the cost but also requires significant amounts of labor in the production as well as the installation of such modules in the submerged operational environment on the ocean floor. Bulky cumbersome objects of this nature are inherently difficult to handle and transport as well as maintain due to the magnitude of their weight. These problems become even more pronounced in view of the undersea water currents usually prevalent in the offshore environs in which breakwaters are installed and maintained.

The present invention is needed to provide a unique modular sea wall system that provides for simpler transportation, delivery, and installation. The present invention is also needed to provide a more compact system that can be efficiently deployed.

SUMMARY OF THE INVENTION

The modular sea wall provides a sea wall constructed from two different blocking bodies: a front blocking body and a rear blocking body. The front blocking body is located seaward and the rear blocking body is located shoreward. The front blocking body provides a front lip that starts at the lowest surface of the front blocking body. The front blocking body curves upward to the uppermost surface of the front blocking body.

The front blocking body attaches to the rear blocking body at the top of the curve. The front blocking body provides an attachment aperture, such as a groove. The rear blocking body provide an attachment tongue that inserts into the attachment aperture of the front blocking body. The attachment of the attachment tongue at the attachment aperture secures the front blocking body with the rear blocking body.

The modular sea wall system provides different types of the rear attachment bodies. One embodiment of the attachment body provides a rear attachment body that has a curve that curves downwards from the attachment point to the rear end of the rear attachment body. Another embodiment of the attachment body provides a vertical wall that extends downward.

It is an object of the present invention to provide a modular sea wall.

It is also an object of the present invention to reduce the energy of waves against the shore.

It is also an object of the present invention to reduce erosion of the shore by waves.

It is also an object of the present invention to provide a bulkhead in the water.

It is also an object of the present invention to provide a modular system that reduces the costs of manufacturing the sea wall.

It is also an object of the present invention to simplify transportation and delivery of the sea wall.

It is also an object of the present invention to simplify the installation of the sea wall.

In addition to the features and advantages of the present invention, further advantages thereof will be apparent from the following description in conjunction with the appended drawings.

These and other objects of the invention will become more fully apparent as the description proceeds in the following specification and the attached drawings. These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
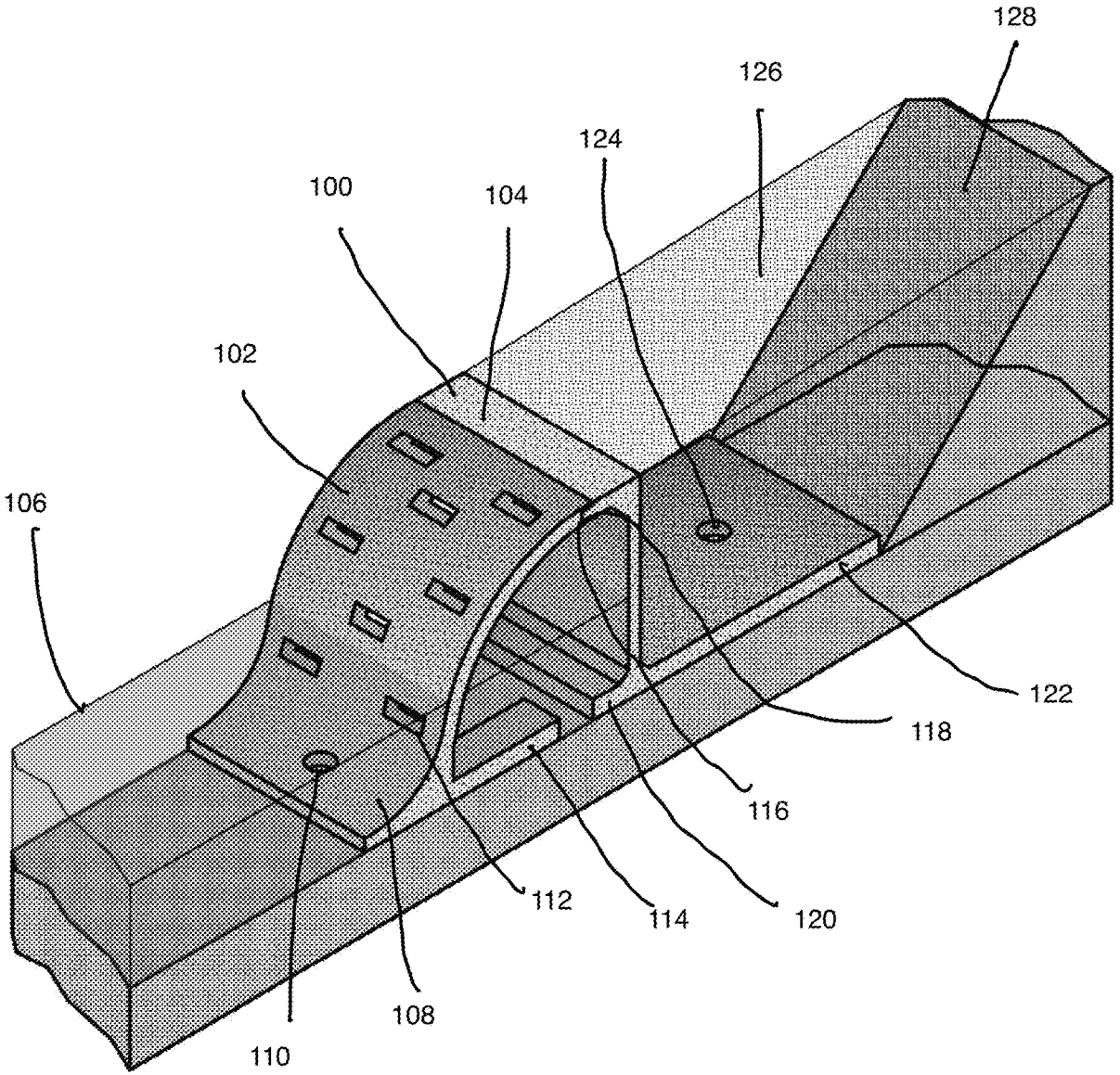
FIG. 1 is an environmental view of one embodiment of the present invention.
Figure 2:
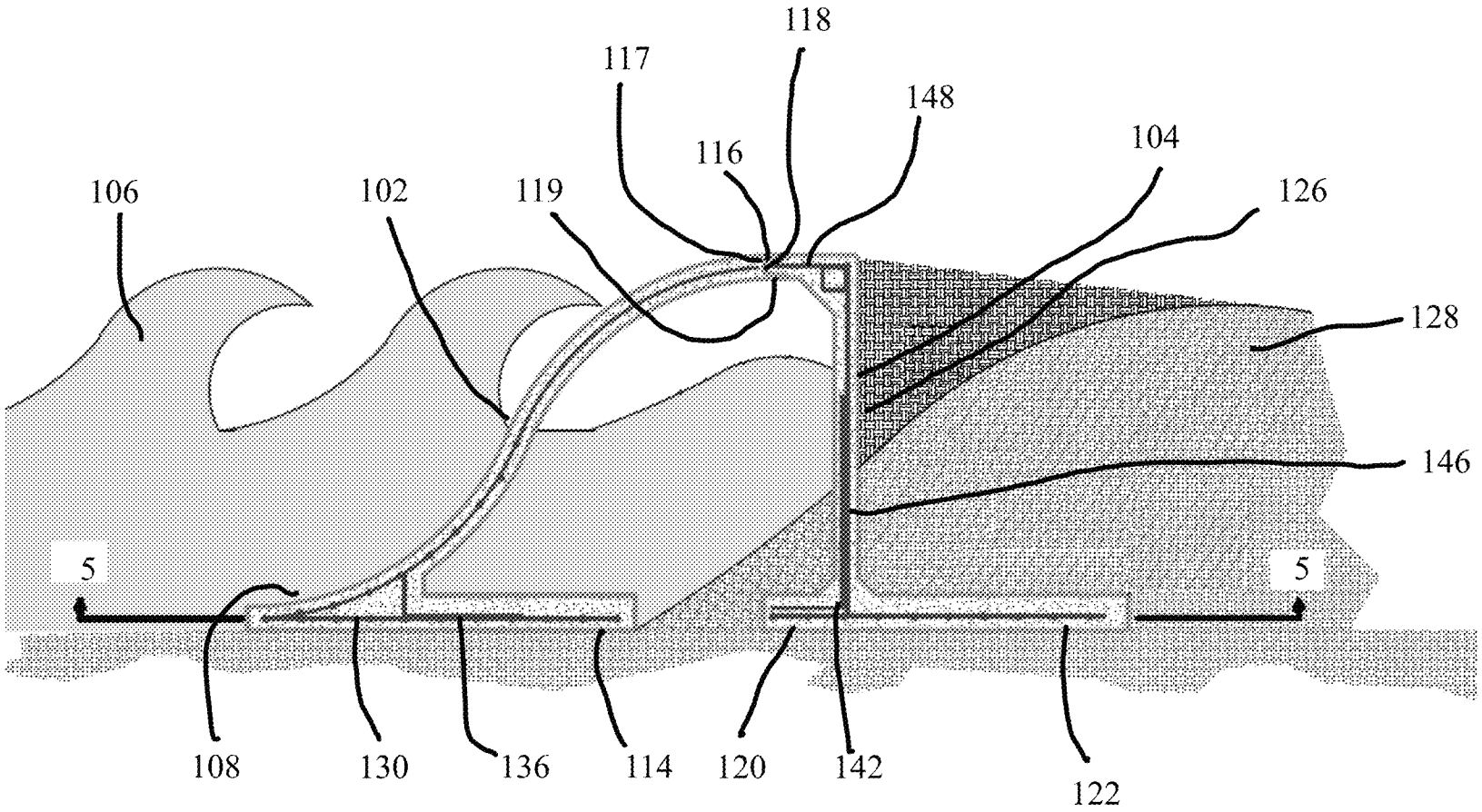
FIG. 2 is an environmental view thereof.

As shown in FIGS. 1 and 2, the modular sea wall provides a sea wall 100 constructed from two different blocking bodies: a front blocking body 102 and a rear blocking body 104. The front blocking body 102 is located seaward and the rear blocking body 104 is located shoreward. The front blocking body 102 reduces the energy of incoming waves 106. The front blocking body 102 dissipates the energy of the incoming wave 106 to reduce the wave to exiting wave 126 that encounters shoreline 128.

The front blocking body 102 provides a base that contacts the floor of the body of the water, such as the ocean floor. Support legs 114, 115 (shown in FIGS. 1, 5, and 14) of the base extend rearward from the front lip 108. The support legs 114, 115 limit movement of the front blocking body 102 while the front blocking body 102 reduces the energy of the waves 106.

The front lip 108 begins at a front surface of the front blocking body 102. The front blocking body curves upward to the top of the front blocking body to the attachment point at which the rear blocking body 104 attaches to the front blocking body 102.

The front blocking body 102 attaches to the rear blocking body 104 at the top of the curve at an attachment point. The rear blocking body 104 attaches to the front blocking body 102 via a fastener, a frictional connection, a tongue and grove connection, or other known attachments. The front blocking body provides an attachment aperture 116, such as a groove, located at the rear end 117 of the front blocking body 102. The rear blocking body 104 provides an attachment tongue 118 located at the front end 119 of the rear blocking body 104 that inserts into the attachment aperture 116 of the front blocking body 102. The attachment of the attachment tongue 118 at the attachment aperture 116 secures the front blocking body 102 with the rear blocking body 104.

Support leg 120 extends longitudinally forward from the attachment of the base of the rear blocking body 104 to the rear wall. Support tail 122 extends rearward from the attachment of the rear wall to the base of the rear blocking body 104. The support leg 120 and support tail 120 form the base to maintain the positioning of the rear blocking body 104 as the waves strike the front blocking body 102 and the rear blocking body 104.

Apertures 112 extend through the curve of the front blocking body 102. The apertures 112 allow the waves 106 to pass through the front blocking body 102. The rear blocking body 104 provides a vertical wall that has no apertures. The energy of the waves 106 dissipates as the waves pass through apertures 112 and as the waves pass over the front blocking body 102.

In one embodiment, the front blocking body 102 and the rear blocking body 104 require anchoring to the sea floor. Anchor apertures 110, 124 accept insertion of a pile to secure the front blocking body 102 and the rear blocking body 104 to the floor, such as the sea floor.

FIG. 2 shows a sectional view of the incoming waves 106 striking the front blocking body 102 and rear blocking body 104. The front lip 108 and the support legs 114, 115 support the front blocking body 102 and limit movement of the front blocking body 102 as the waves 106 strike the front blocking body 102.

The rear blocking body 104 also supports and limits the movement of the front blocking body 102. The attachment of the front blocking body 102 to the rear blocking body 104 at the attachment aperture 116 and the attachment tongue 118 supports the top of the front blocking body 102. The support leg 120 and support tail 122 also support the rear blocking body 104 and the front blocking body 102.

For additional support of the rear blocking body 104, the rear blocking body 104 may be installed within the shoreline 128. The shoreline is excavated to bury the base, the support leg 120, and the support tail 122 within the shoreline. The top of the rear blocking body 104 extends above the floor.

The front blocking body 102 and rear blocking body 104 are constructed from reinforced concrete. The reinforced concrete may be reinforced with rebar, fiberglass, welded wire mesh, or other reinforced materials. The concrete has a welded wire mesh 130, 138, 146, 148 embedded within the concrete of the front blocking body 102 and the rear blocking body 104. The welded wire mesh 130, 138, 146, 148 strengthens and shapes the front blocking body 102 and the rear blocking body 104.

L-bars 136, 142 within the concrete of the front blocking body 102 and rear blocking body 104 also support the vertical rise of the front blocking body 102 and rear blocking body 104. These L-bars 136, 142 are embedded within the concrete.

Figure 3:
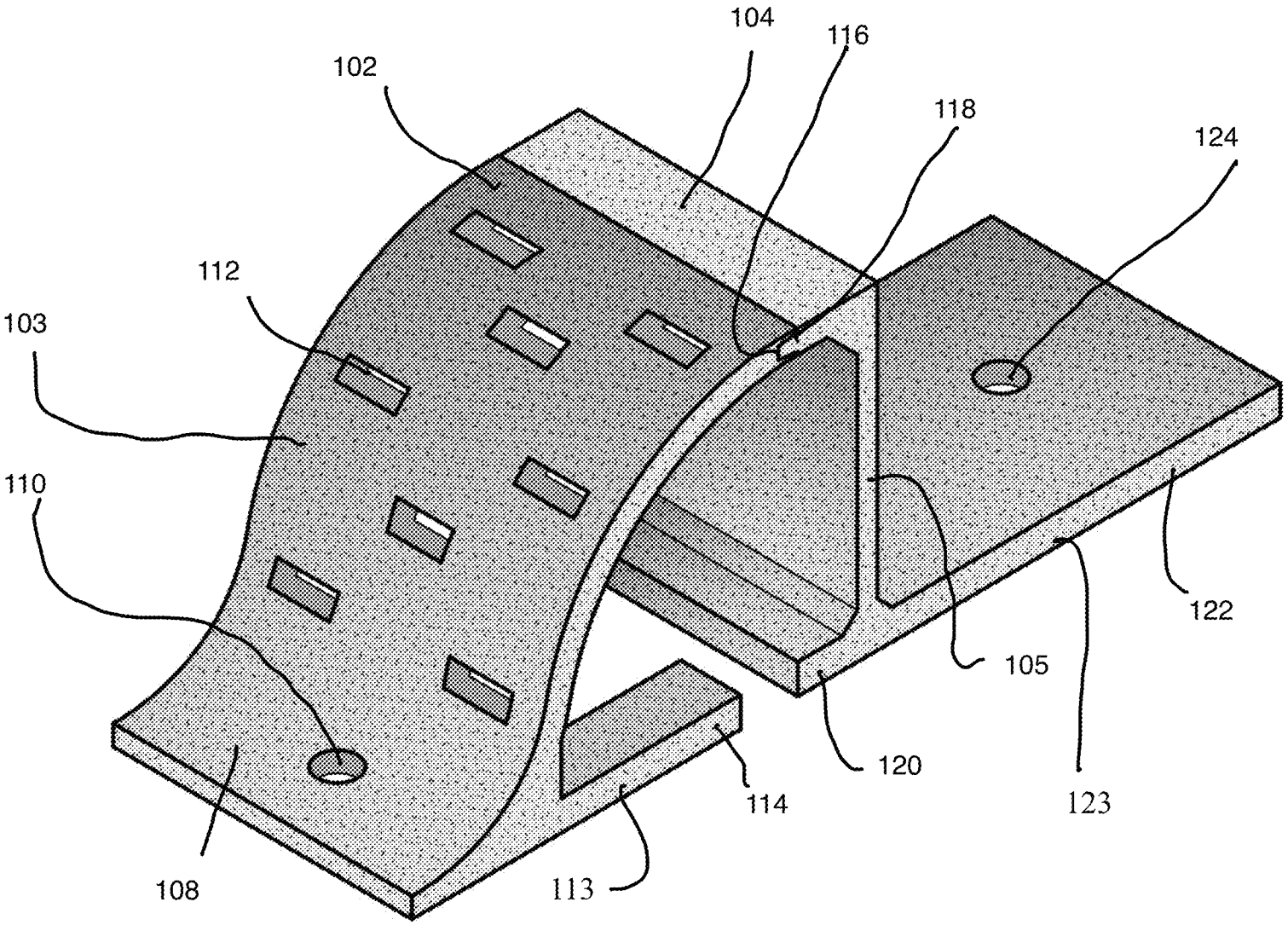
FIG. 3 is a perspective view thereof.

FIG. 3 shows the front blocking body 102 secured to the rear blocking body 104. The apertures 112 allow the water to pass through the curved front wall 103 of the front blocking body 102. The water passes through front blocking body 102 to the rear blocking body 104. Vertical wall 105 of the rear blocking body 104 provides no apertures for the water to pass. The water strikes the vertical wall 105 of the rear blocking body 104. The front blocking body 102 and rear blocking body 104 reduce the energy of the incoming waves.

The base 113 extends from the front end of the front blocking body 102 to the end of the support legs 114. The base 113 is located vertically below the front wall 103. Base 123 of the rear blocking body 104 extends from the front of support leg 120 to the rear end of the support tail 122. Base 123 is located vertically below the attachment point. Anchor apertures 110, 124 extend vertically through the bases 113, 123.

As discussed above, support legs 114, 120 and support tail 122 support the front blocking body 102 and the rear blocking body 104. Anchor apertures 110, 124 enable the insertion of a pile to secure the front blocking body 102 and the rear blocking body 104 to the floor.

Figure 4:
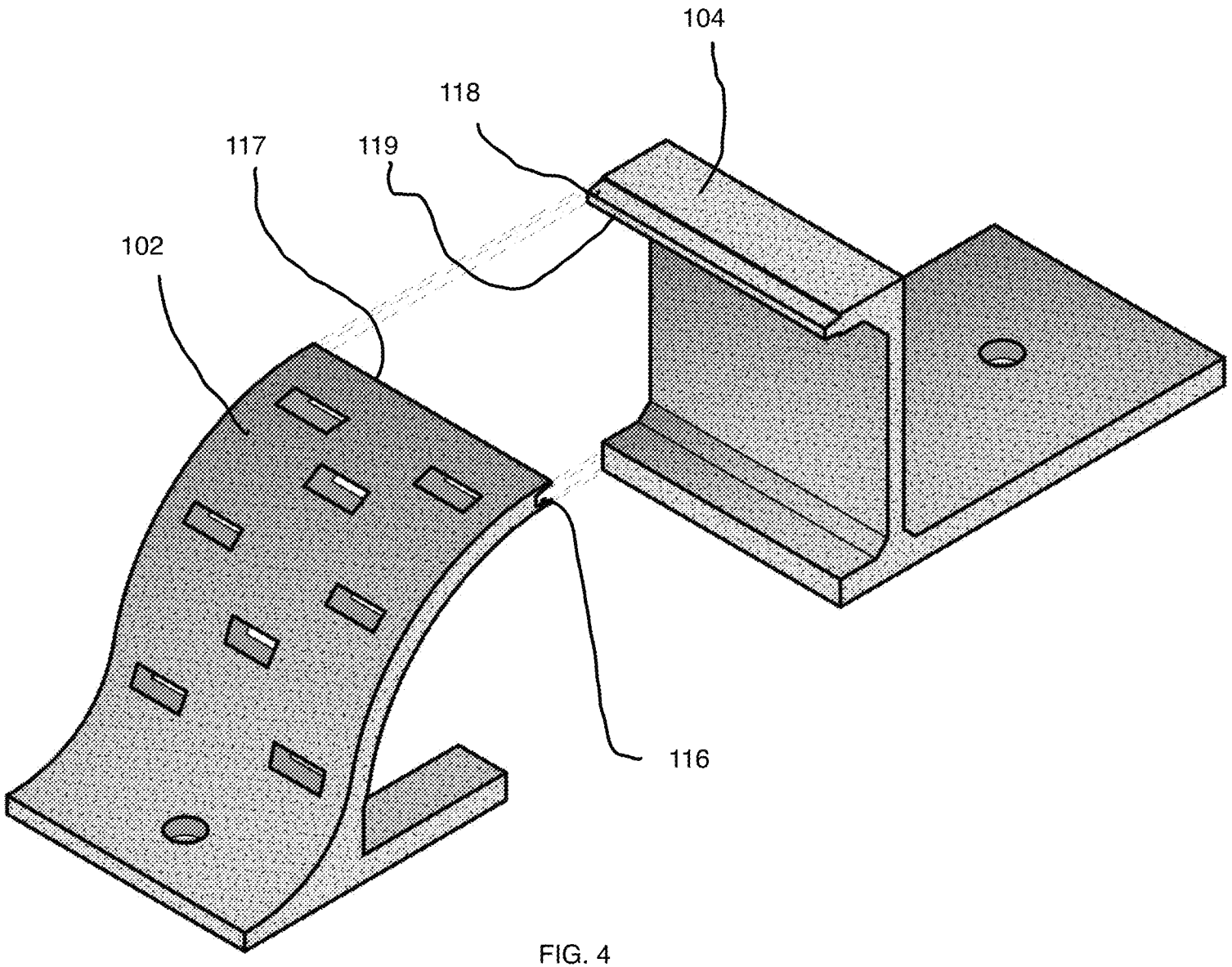
FIG. 4 is a perspective view thereof.

Referring to FIGS. 3 and 4, the front blocking body 102 secures to the rear blocking body 104 via a tongue and groove attachment. The tongue has been described as extending from the rear blocking body and inserted into the groove of the front blocking body. The tongue and groove may be modified such that the tongue extends from the front blocking body and inserted into the groove of the rear blocking body. Other attachments may secure the front blocking body to the rear blocking body, including but not limited to fasteners, frictional engagements, joints, braces, brackets, and other attachments.

The attachment aperture 116 at the rear end 117 of front blocking body 102 accepts attachment tongue 118 located at the front end 119 of the rear attachment body 104. Rear attachment body 104 with support leg 120 and support tail 122 position the front blocking body 102 and limit movement of the top and upper portion of the front blocking body 102.

FIG. 4 shows the front blocking body 102 separated from the rear blocking body 104. The attachment tongue 118 inserts into attachment aperture 116 as a tongue and groove connection. The ability to separate front blocking body 102 from the rear blocking body 103 simplifies transporting the front blocking body 102 and the rear blocking body 104. Such a tongue and groove attachment allows users to quickly attach the front blocking body 102 with the rear blocking body 104 at the attachment point.

Figure 5:
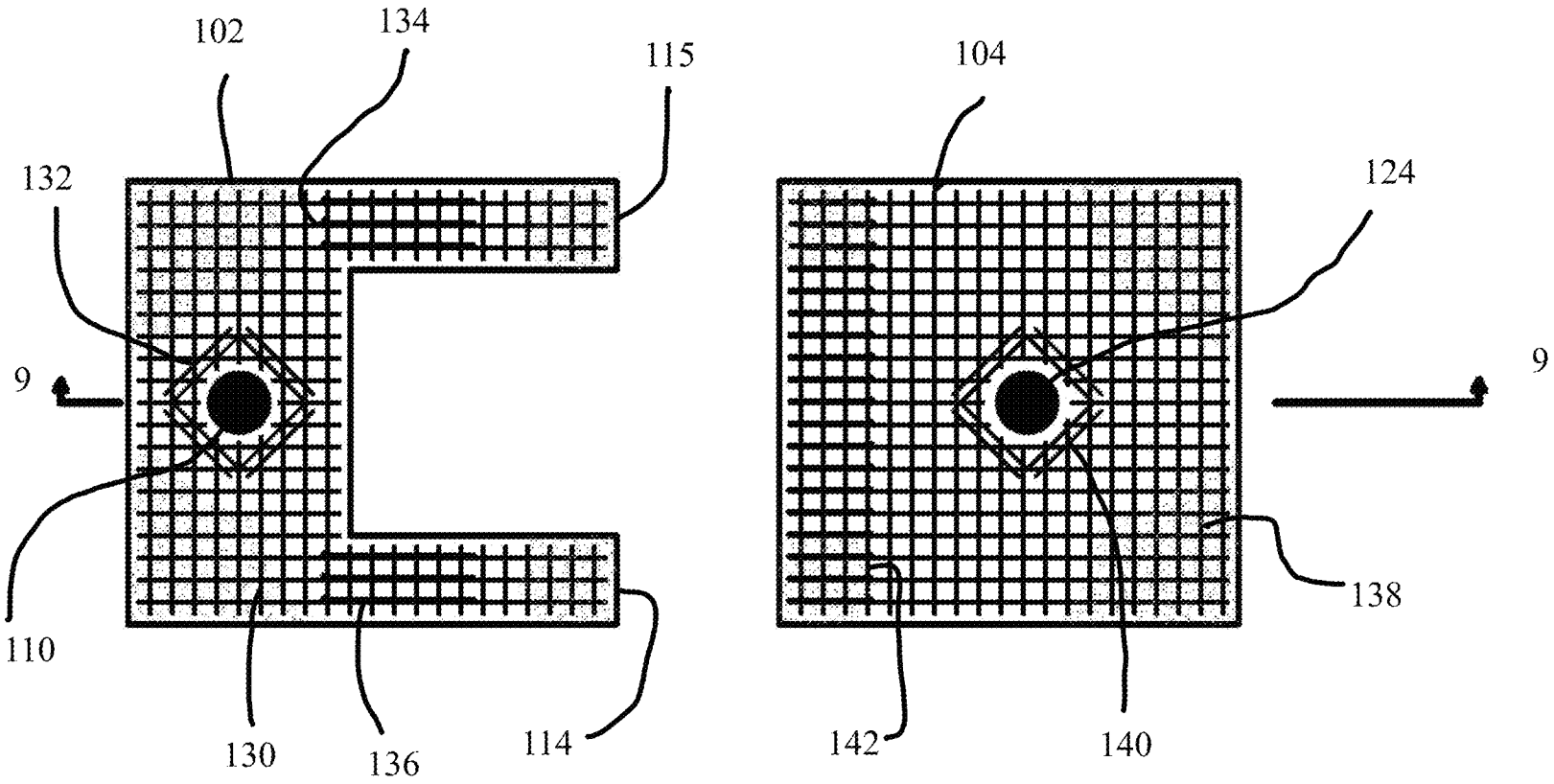
FIG. 5 is a sectional view thereof.

FIG. 5 shows the sectional view of the front blocking body 102 and the rear blocking body 104. As discussed above the welded wire mesh 130, 138 embedded in the concrete reinforces the structure and shape of the front blocking body 102 and the rear blocking body 104. L-bars 134, 136 located in the legs 114, 115 extend upward to provide vertical supports to the curved front wall of the front blocking body 102. Similarly, L-bars 142 in the rear blocking body extend upwards to provide vertical support to the vertical wall of the rear blocking body 104. The vertical wall of the rear blocking body 104 extends upwards without curving.

Reinforcement bodies 132, 140, such as a rigid bar or number of rigid bars, are positioned around the anchor apertures 110, 124. The reinforcement bodies 132, 140 reinforce the anchor apertures 110, 124 to limit damage from the pile extending through the anchor apertures 110, 124.

Figure 6:
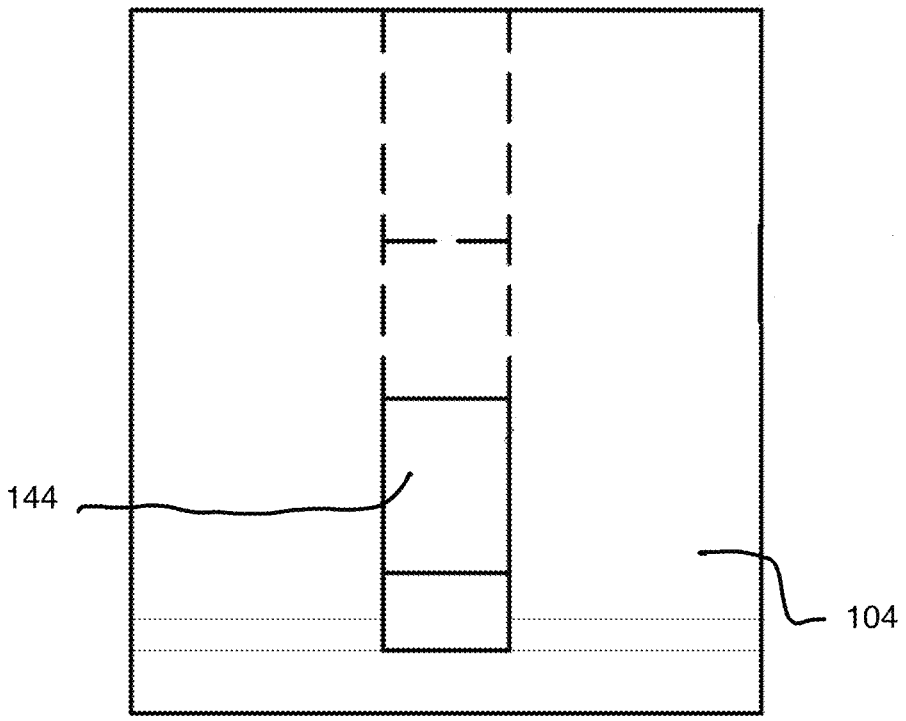
FIG. 6 is a rear view thereof.
Figure 7:
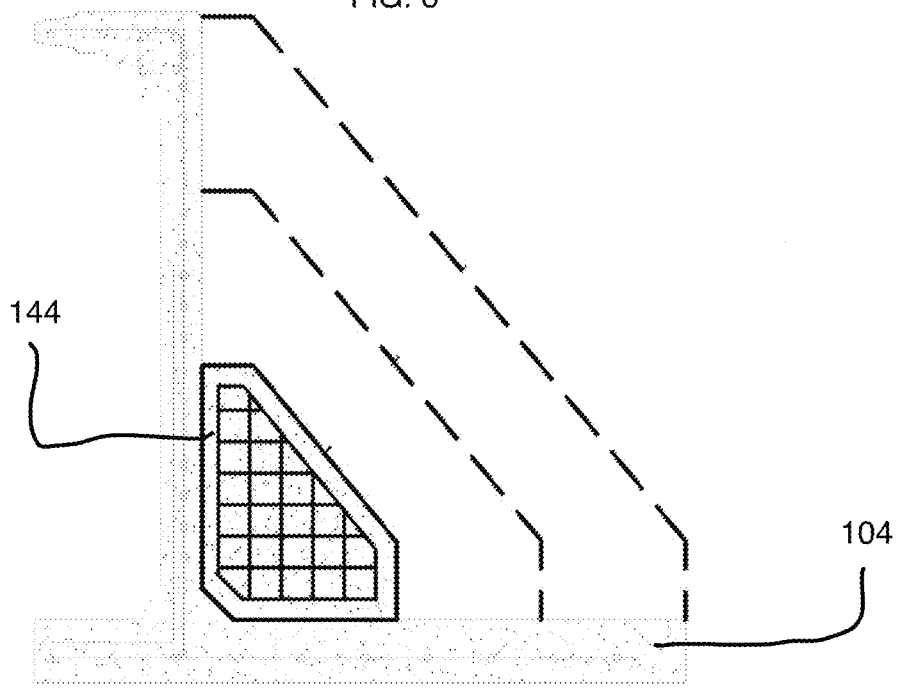
FIG. 7 is a sectional view thereof.

FIGS. 6 and 7 show the back of rear blocking body 104 with counterfort 144. The counterfort is positioned on the shoreward (rear) side of the rear blocking body 104 to strengthen and reinforce the vertical wall of the rear blocking body.

Figure 8:
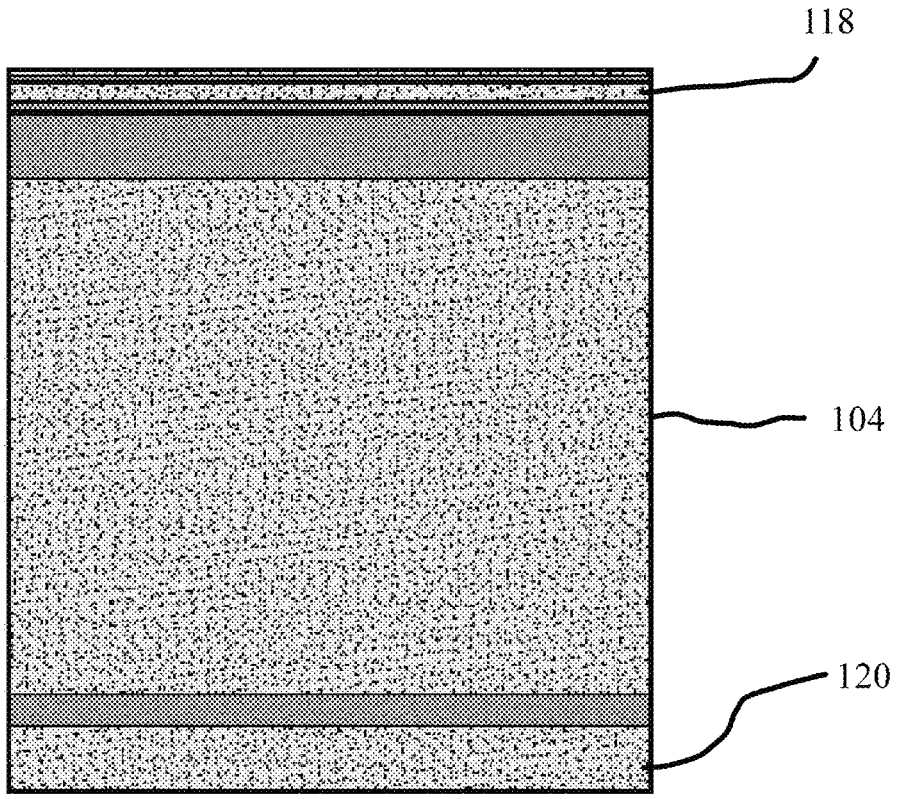
FIG. 8 is a front view of a rear blocking body of one embodiment of the present invention.
Figure 9:
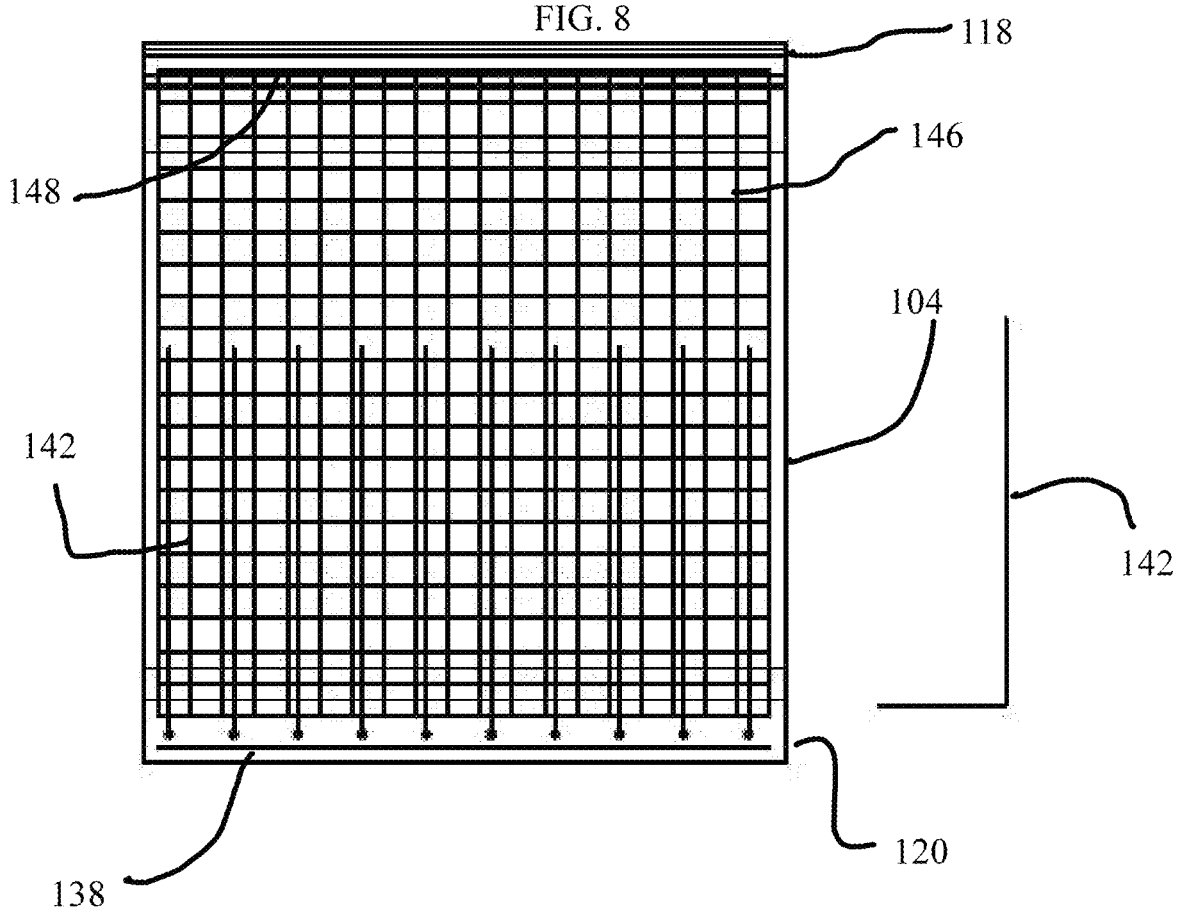
FIG. 9 is a sectional view thereof.

FIGS. 8 and 9 show the rear blocking body 104. The front blocking body 102 and the rear blocking body 104 are constructed from a rigid material, such as concrete, that can withstand the water and the waves. In one embodiment, the rigid material, such as the concrete, is reinforced with a metal reinforcement within the rigid material.

FIG. 9 shows the welded wire mesh 138 at the base of the rear blocking body 104 extending through the base, the support leg 120, and the support tail 122. Wire mesh 138 reinforces and strengthens the base 123 of the rear blocking body 104. The L-bars 142 provide additional strength to the vertical wall of the rear blocking body 104. The L-bars 142 strengthen the base 123 and the vertical wall due to the L-shape of the bars 142.

FIG. 9 also shows the wire mesh 148 located at the top of the rear blocking body 104. The wire mesh 148 reinforces and strengthens the top of the rear blocking body 104. The wire mesh 148 at the top also strengthens the attachment tongue 118 for securing the rear blocking body 104 with the front blocking body 102.

Figure 10:
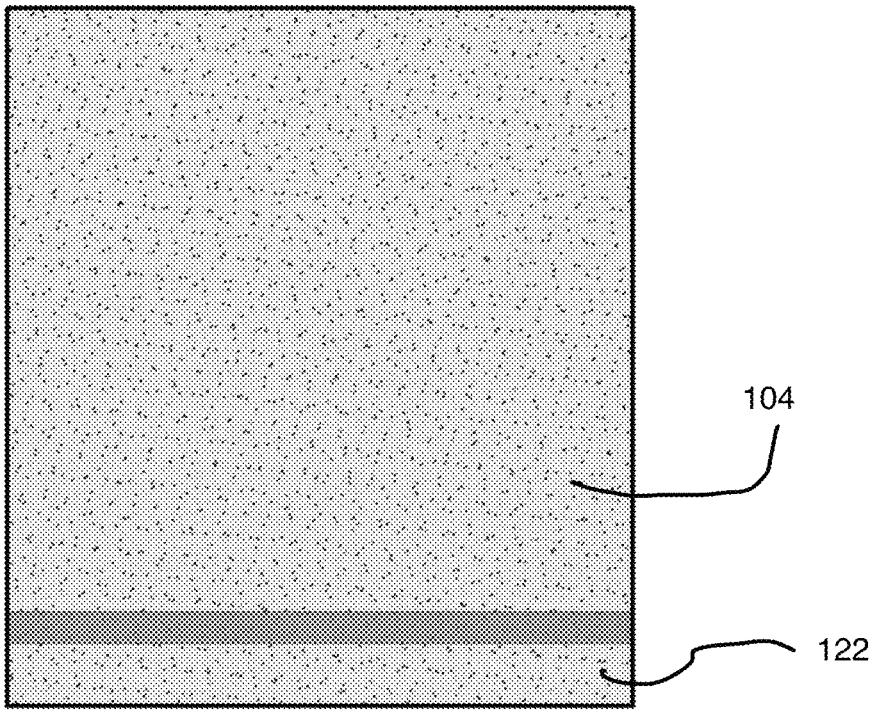
FIG. 10 is a rear view thereof.
Figure 11:
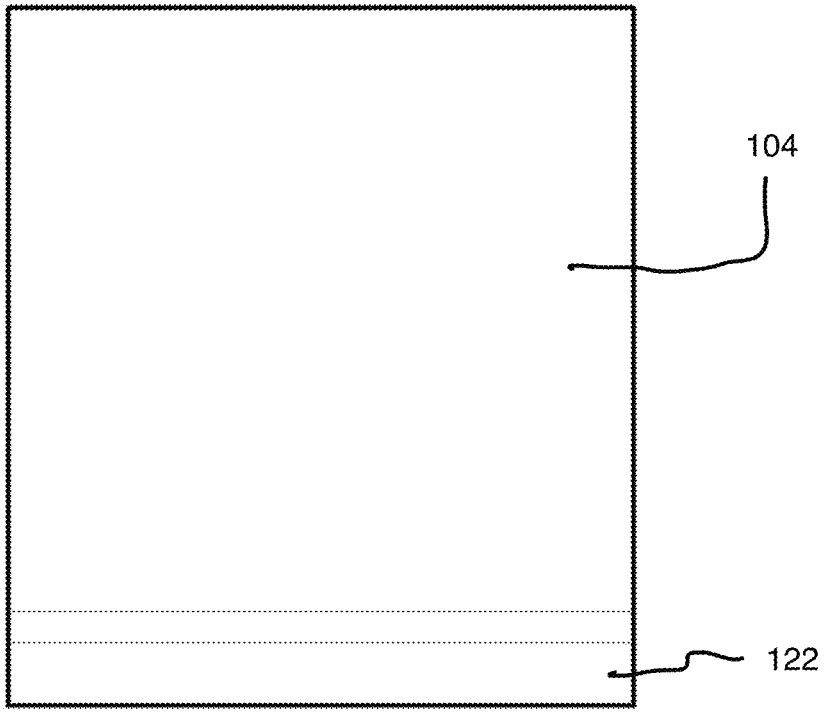
FIG. 11 is a rear view thereof.

FIGS. 10 and 11 show the rear side of the rear blocking body 103 that is positioned shoreward. The support tail 122 positions the rear blocking body 104 to limit movement of the rear blocking body 104. As discussed above, the base 123 and the support tail 122 of one embodiment may be buried under the floor to maintain the position of the rear blocking body 104.

Figure 12:
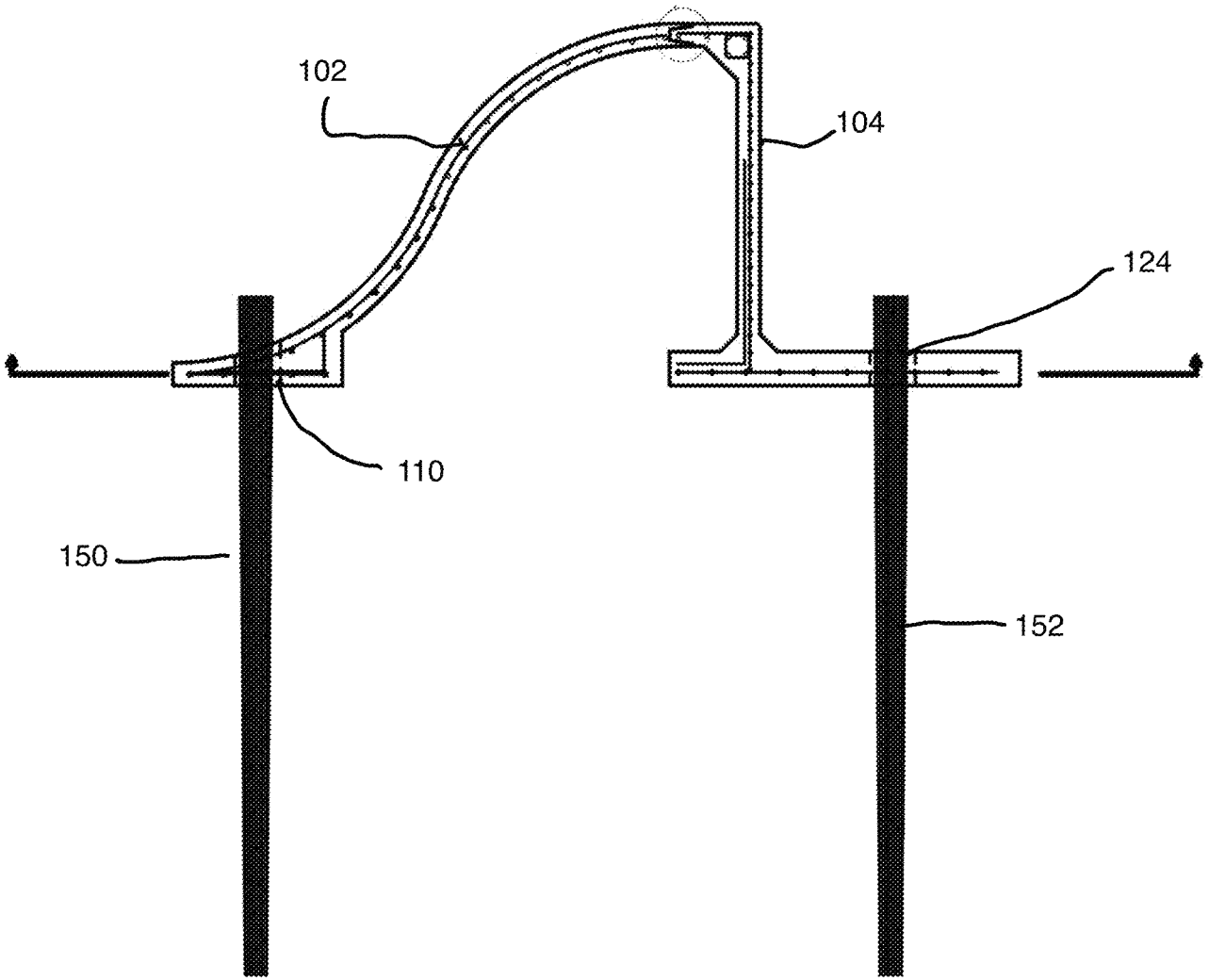
FIG. 12 is a environmental view of one embodiment of the present invention.

FIG. 12 shows a sectional view of the front blocking body 102 and the rear blocking body 104 secured to one another while anchored into the floor. Piles 150, 152 insert into the anchor apertures 110, 124 of the front blocking body 102 and the rear blocking body 104. The piles 150, 152 anchor the front blocking body 102 and the rear blocking body 104 to reduce movement of the front blocking body 102 and the rear blocking body 104 while reducing the energy of the waves striking the blocking bodies 102, 104.

Figure 13:
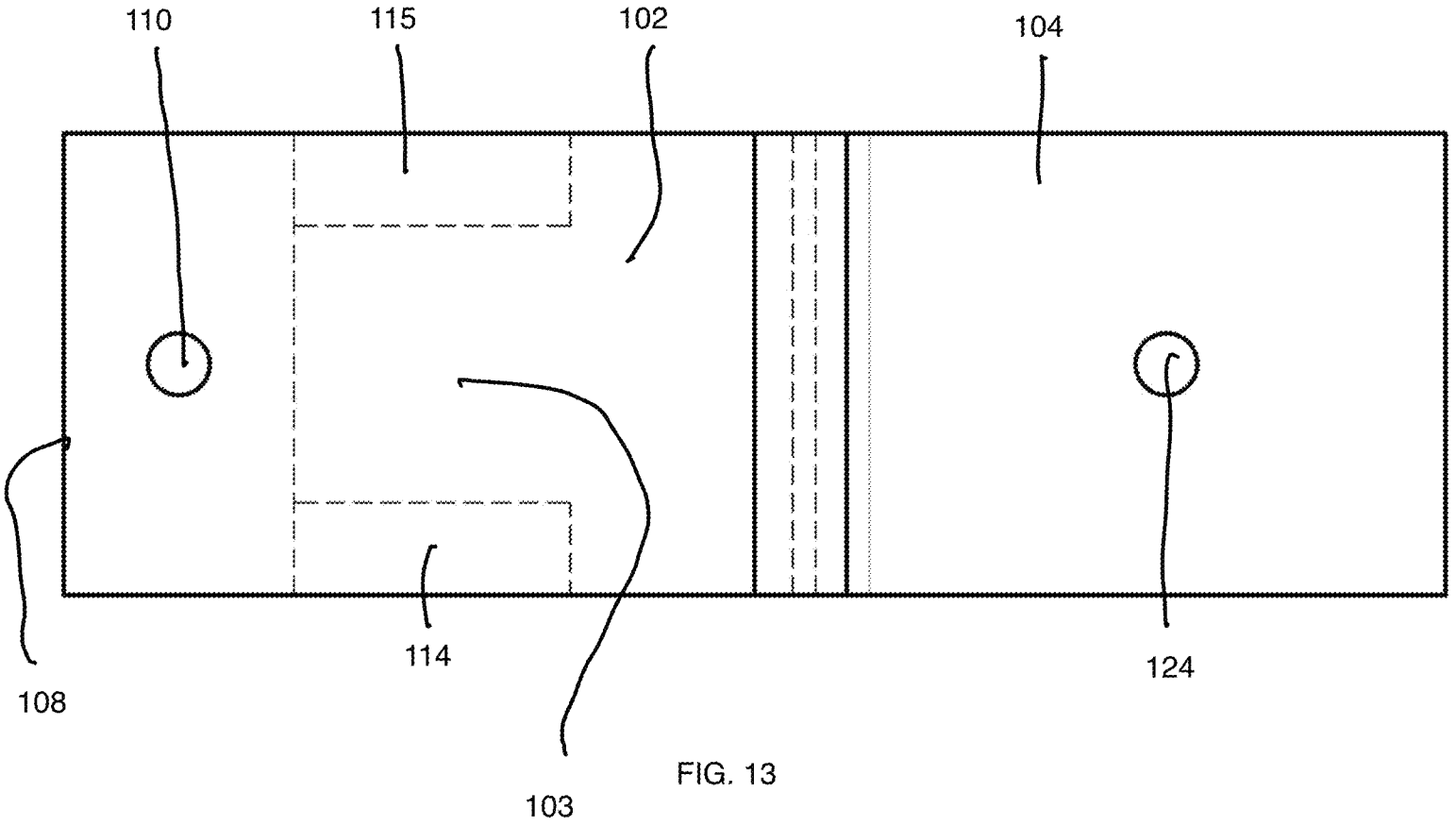
FIG. 13 is a top view thereof.

FIG. 13 shows a top view of the front blocking body 102 and the rear blocking body 104. The front blocking body 102 overlaps with the rear blocking body 104 to secure the front blocking body 102 with rear blocking body 104. Legs 114, 115 extend rearward from the lip 108 underneath the curved front wall 103. These support legs 114, 115 support the front blocking body 102.

FIG. 13 also shows positioning of the anchor apertures 110, 124. As discussed above, the anchor apertures 110, 124 accept a pile, such as a wooden pile, to secure the front blocking body 102 and rear blocking body 104 to the floor.

Figure 14:
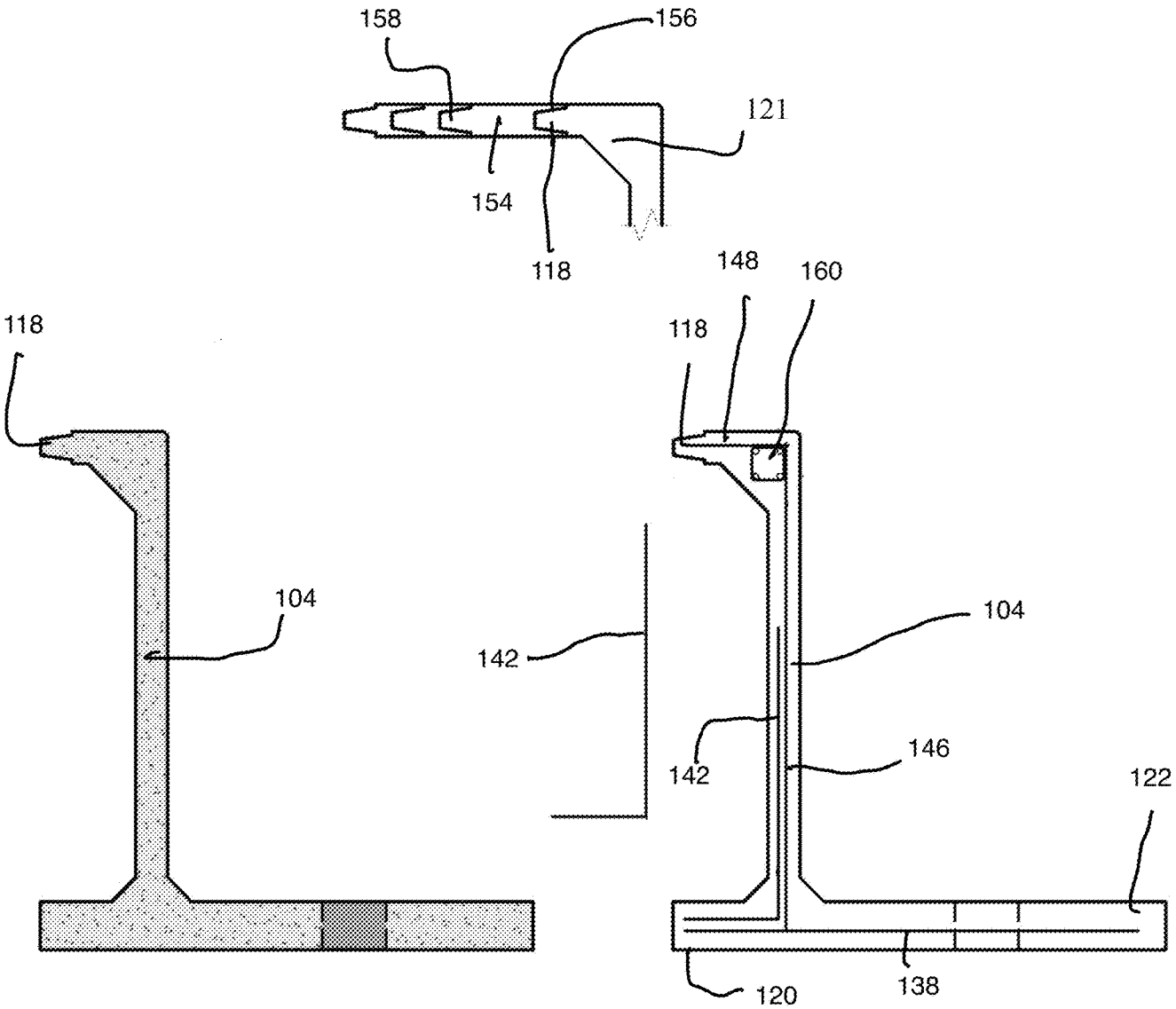
FIG. 14 is a sectional view of a rear blocking body of one embodiment of the present invention.

FIG. 14 shows the rear blocking body 104. Wire mesh 138 extends through the base of the rear blocking body 102. The wire mesh 138 extends through the support leg 120 and the support tail 122. Wire mesh 146 extends upward through the vertical wall of the rear blocking body 104. Wire mesh 148 extends horizontally to the attachment tongue 118. Support bar 160 extends across the upper portion of the rear blocking body 104 to support wire mesh 148. Attachment arm 121 extends longitudinally forward from the rear wall 104. The attachment point is located at the front end of the attachment arm 121. The supports including support bar 160 and wire mesh 148 extend into the attachment arm 121.

The L-bar 142 and the wire mesh 146 support the vertical wall. Both the L-bar 142 and the wire mesh 146 extend upward through the vertical wall. L-bar 142 also extends forward from the vertical wall through the support leg 120.

FIG. 14 also shows extender bodies 154. These extender bodies 154 enable customization of the distance between the front blocking body 102 and the rear blocking 104. These extender bodies 154 increase the length of the attachment tongue 118. The extender bodies 154 provide an attachment aperture 156 and attachment tongue 158. The attachment aperture 156 accepts attachment tongue 118 or attachment tongues 158 of other extender bodies 154. The attachment tongue 158 secures within the receiving aperture 156 of other extender bodies 154 or the attachment aperture 116 of the front blocking body 102. The user can insert one or more extender bodies 154 to place the front blocking body 102 the appropriate distance from the rear blocking body 104.

Figure 15:
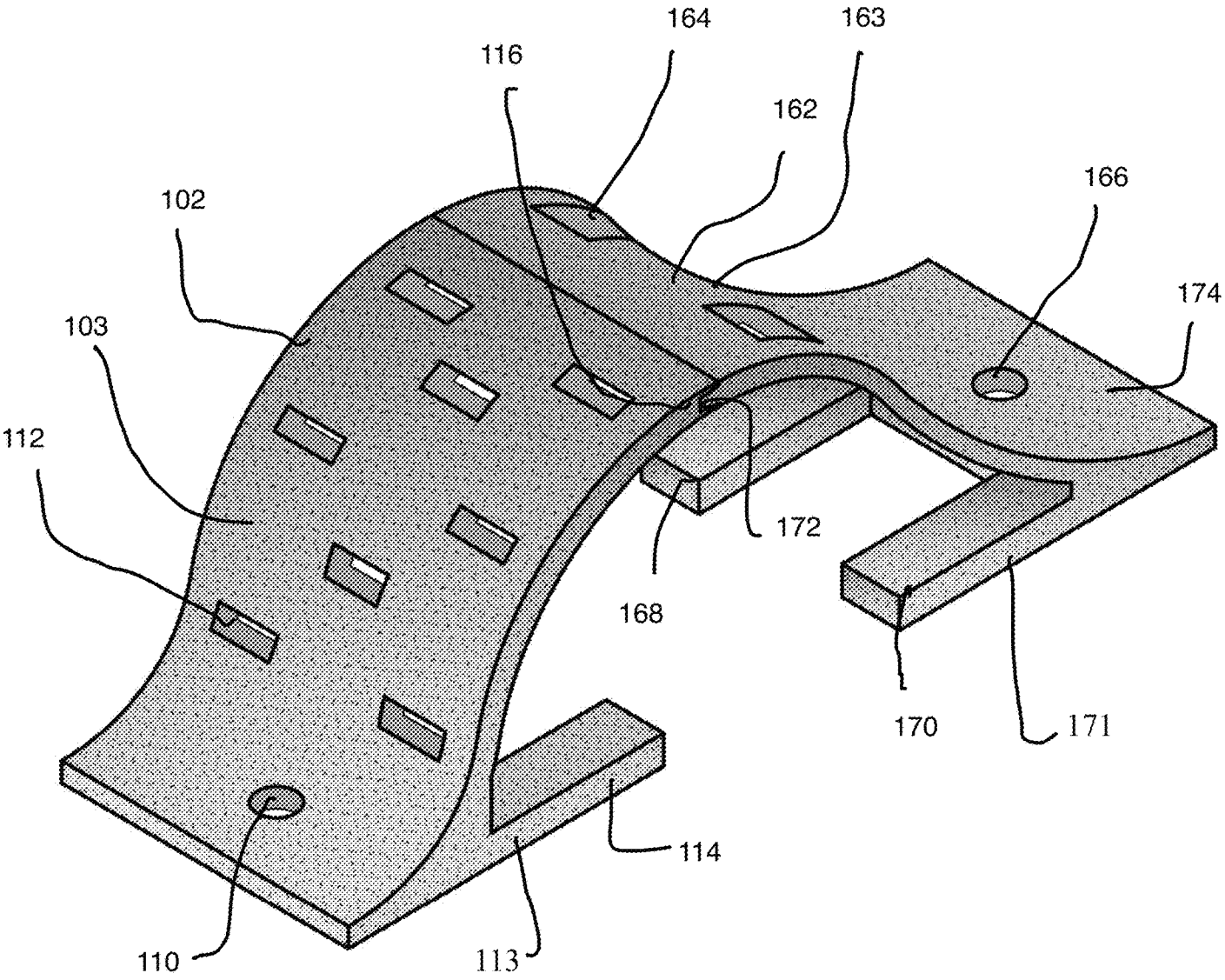
FIG. 15 is a perspective view of one embodiment of the present invention.
Figure 16:
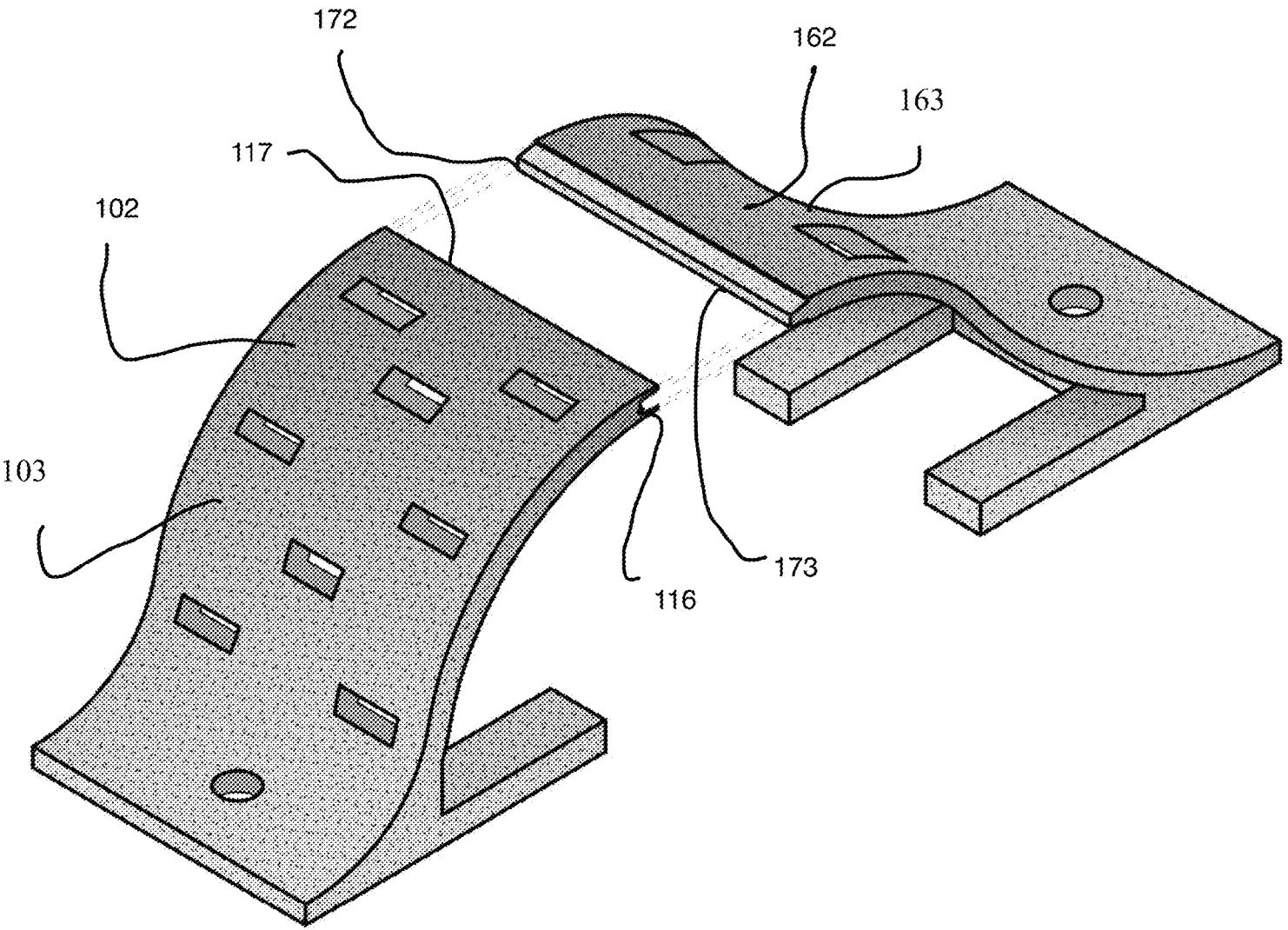
FIG. 16 is a perspective view thereof.

FIGS. 15 and 16 show another embodiment of the rear blocking body 162. Rear blocking body 162 provides a curved rear wall 163. The curved rear wall 163 curves downwards from the attachment point at front blocking body 102 rearward to the rear end 174. The curve of the rear wall 163 mirrors the curve of the front wall 103. The curve of the rear wall 163 and the front wall 103 form a wave pattern. In one embodiment, the wave pattern of the front wall 103 and the rear wall 163 form a crest (highest point) located at the attachment point and a trough (lowest point) located at the base of the respective blocking body. The distance between the trough of the front wall 103 and the trough of the rear wall 163 form a wavelength.

Support legs 168, 170 extend forward from the rear end 174 under the curved rear wall 163. Support legs 168, 170 maintain the positioning of the rear blocking body 162. Support legs 168, 170 also support the top of the front blocking body 102 at the attachment point. Support legs 168, 170 function similarly to support legs 114, 115 of the front blocking body 102.

The rear blocking body 162 also provides apertures 164 through the rear curved wall 163. The apertures 164 function similarly to the apertures 112 through the front curved wall 103 of front blocking body 102. The apertures 112, 164 allow a portion of the water associated with the incoming waves to pass through the front curved wall 103 and the rear curved wall 163.

FIG. 16 shows the detachment of front blocking body 102 from the rear blocking body 162. Front blocking body 102 and rear blocking body 162 secure to each other via a tongue and grove attachment via the attachment aperture 116 located at the rear end 117 of the front blocking body 102 and the attachment tongue 172 located at the front end 173 of the rear blocking body 162. As discussed above, the tongue and groove attachment may be modified to place the tongue on the front blocking body and the groove on the rear blocking body. Other attachments including but not limited to fasteners, frictional engagements, joints, braces, brackets, and other attachments may secure the front blocking body with the rear blocking body.

The extenders 154 shown in FIG. 14 can be secured between the front blocking body 102 and the rear blocking body 162 to increase the distance between the front blocking body 102 and the rear blocking body 162. Attachment tongue 172 inserts into attachment aperture 116 to secure the front blocking body 102 with the rear blocking body 162.

Figure 17:
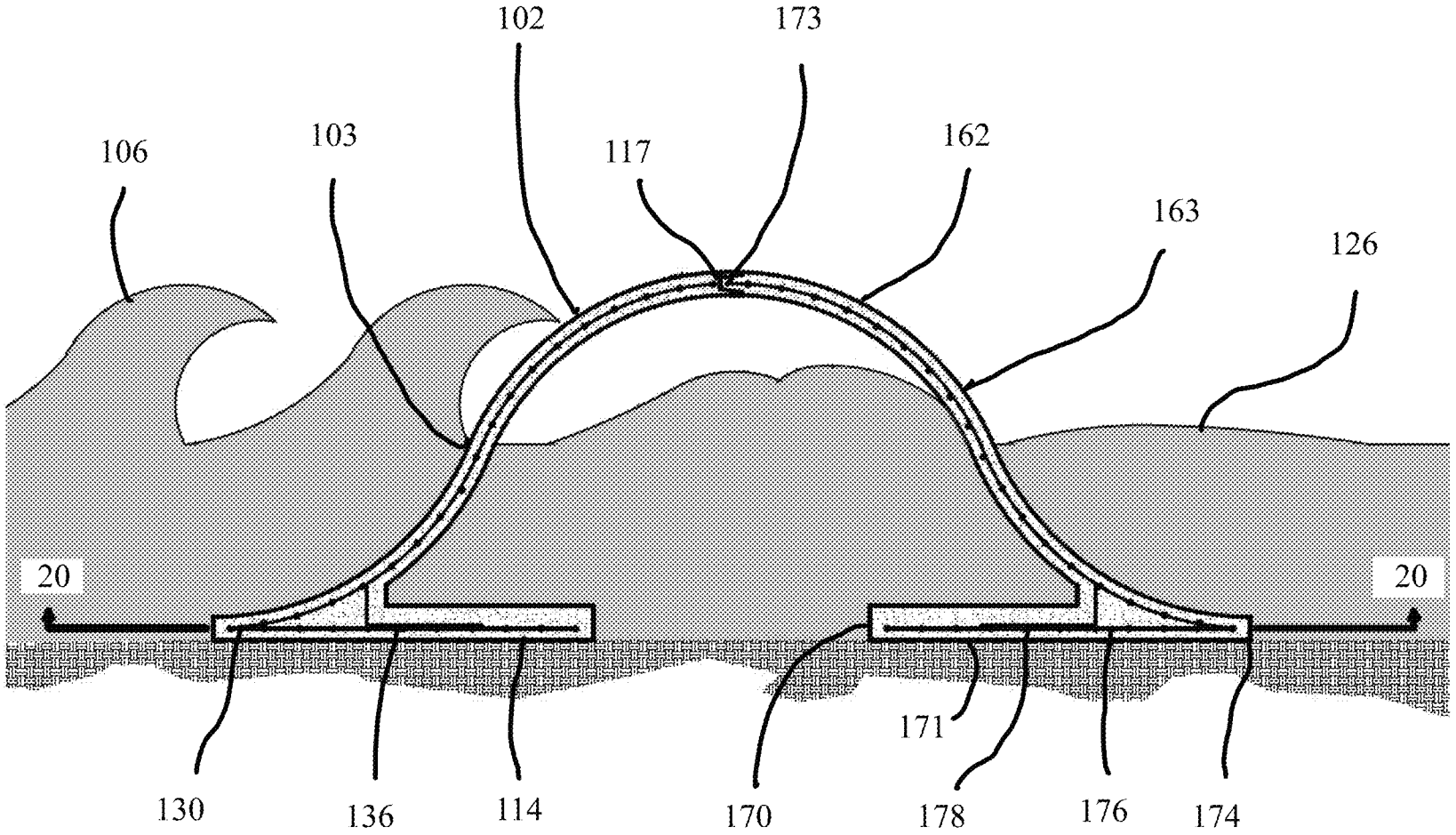
FIG. 17 is an environmental view thereof.

FIG. 17 shows a sectional view of the rear end 117 of the front blocking wall 103 secured to the front end 173 of the rear blocking wall 163. The curvature of the rear blocking wall 163 mirrors the curvature of the front blocking wall 103. Wire mesh 130, 176 extends along the base 113, 171 of the front and rear blocking bodies 102, 162 along and upward along the curved walls 103, 163. The wire mesh 130, 176 reinforces and strengthens the front and rear blocking bodies 102, 162. The front curved wall 103 extends rearward over the support legs 114, 115. The rear curved wall 163 extends forward over the support legs 168, 170.

L-bars 136, 178 located in the bases of the blocking bodies 102, 162 extend through the support legs 114, 115, 168, 170 and upward into the curved wall 103, 163. The L-bars 136, 178 provide additional support to the curved wall 103, 163 to maintain the structure of the blocking bodies 102, 162.

As discussed above, the incoming waves 106 pass through the apertures of the front curved wall 103 and the rear curved wall 163 to reduce the size of the outgoing wave 126. The front blocking body 102 and the rear blocking body 162 reduce the energy of the incoming waves 106 to dissipate the strength of the outgoing wave 126.

Anchor apertures 110, 166 accept a pile, such as a wooden pile, to secure the front blocking body 102 and rear blocking body 162 to the floor. The pile inserts into the anchor apertures 110, 166 into the floor to secure the front blocking body 102 and the rear blocking body 162.

Figure 18:
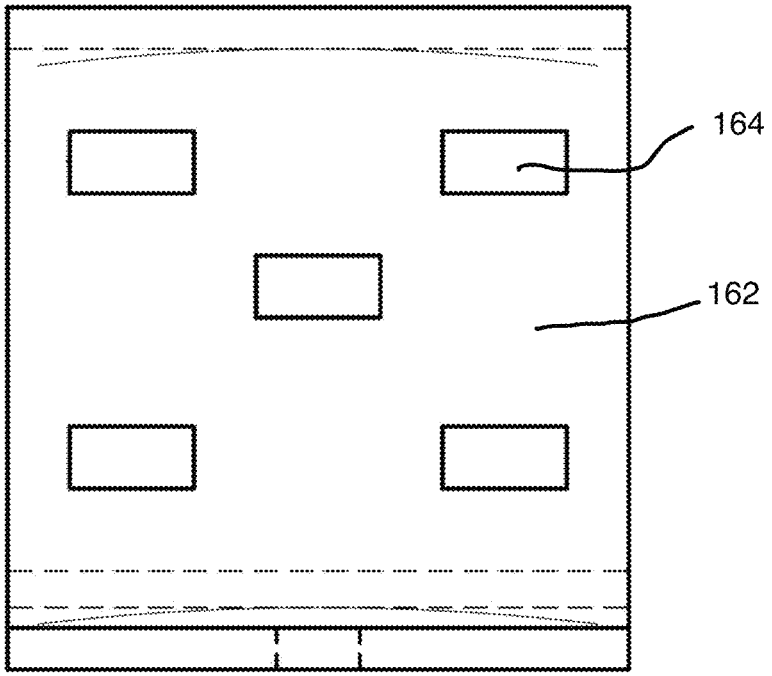
FIG. 18 is a front view of one embodiment of the present invention.
Figure 19:
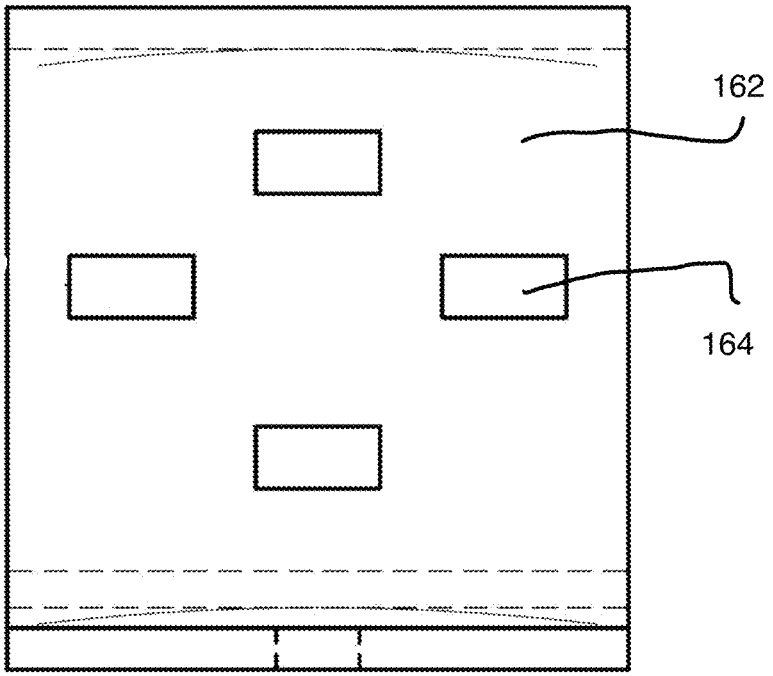
FIG. 19 is a front view of one embodiment of the present invention.

FIGS. 18 and 19 show different arrangements of the apertures 112, 164 through the curved walls 103, 163 of the blocking bodies 102, 162. The apertures 112, 164 may vary according to the environment in which the blocking bodies are installed. The configuration of the apertures 112, 164 may also vary according to the environment in which the blocking bodies 102, 162 are installed. In one embodiment, the configuration of the apertures of curved front wall 103 align with the configuration of the apertures of the curved rear wall 163.

The apertures 112, 164 may pass straight through curved walls such that the openings are parallel to the bases 113, 171. In another embodiment, the apertures 112, 164 are angled downward from sea ward to shoreward. For example, the aperture 112 angles downward towards the support legs 114. Apertures 164 angle downward towards the rear end 174. In one embodiment, the apertures 112, 164 angle downward at a 45 (forty five) degree angle in relation to the base. In one embodiment, the apertures 112, 164 angle downward between 30 (thirty) degrees and 60 (sixty) degrees in relation to the base.

Figure 20:
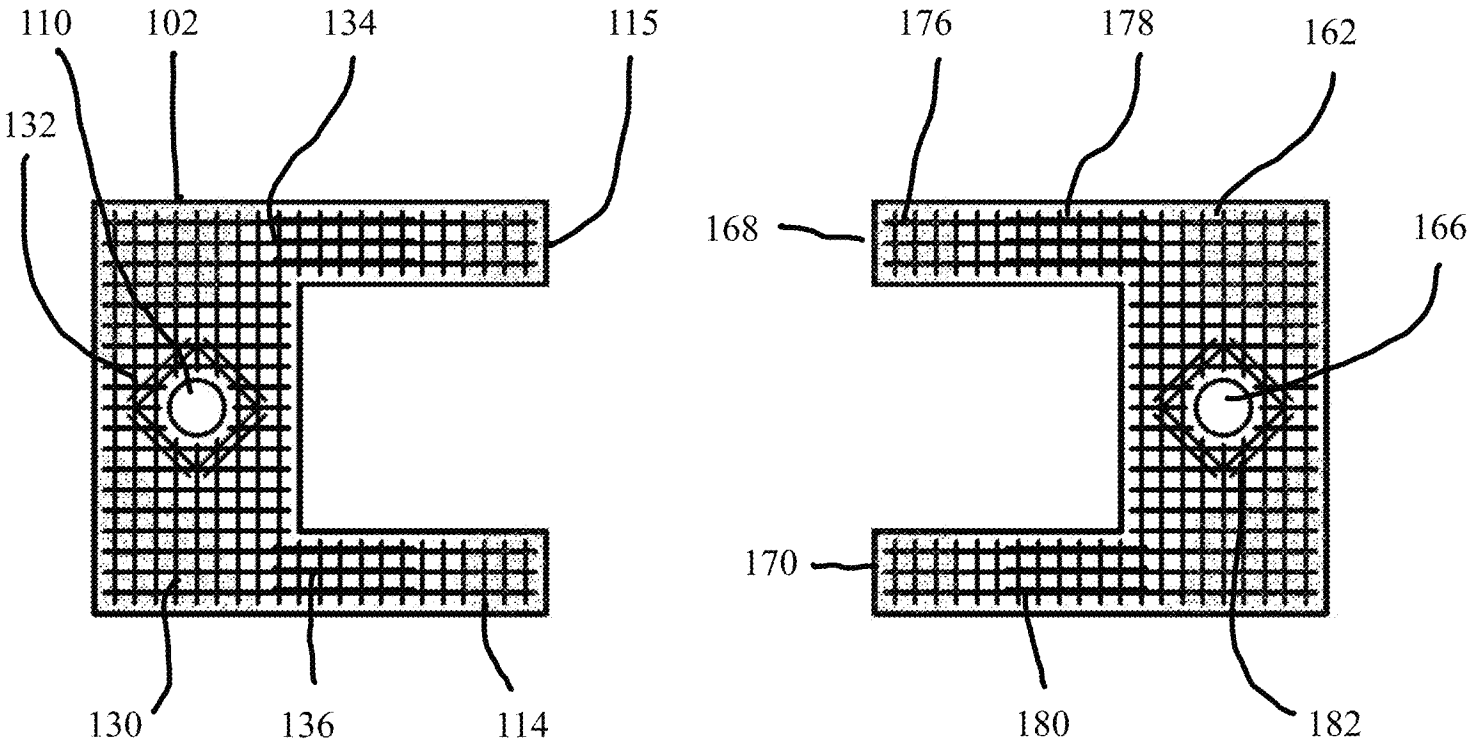
FIG. 20 is a sectional view thereof.

FIG. 20 shows the sectional view of blocking bodies 102, 162. As discussed above, the wire mesh 130, 176 extends through the bases, the legs 114, 115, 176, 178, and the curved walls 103, 163 of the blocking bodies 102, 162. The wire mesh 130, 176 strengthens and reinforces the blocking bodies 102, 162. The wire mesh 130, 176 is embedded within the concrete of the blocking bodies 102, 162 as discussed above.

Reinforcement bodies 132, 182, such as a rigid bar or number of rigid bars, are positioned around the anchor apertures 110, 166. The reinforcement bodies 132, 182 reinforce the anchor apertures 110, 166 to limit damage from the pile extending through the anchor apertures 110, 166.

Figure 21:
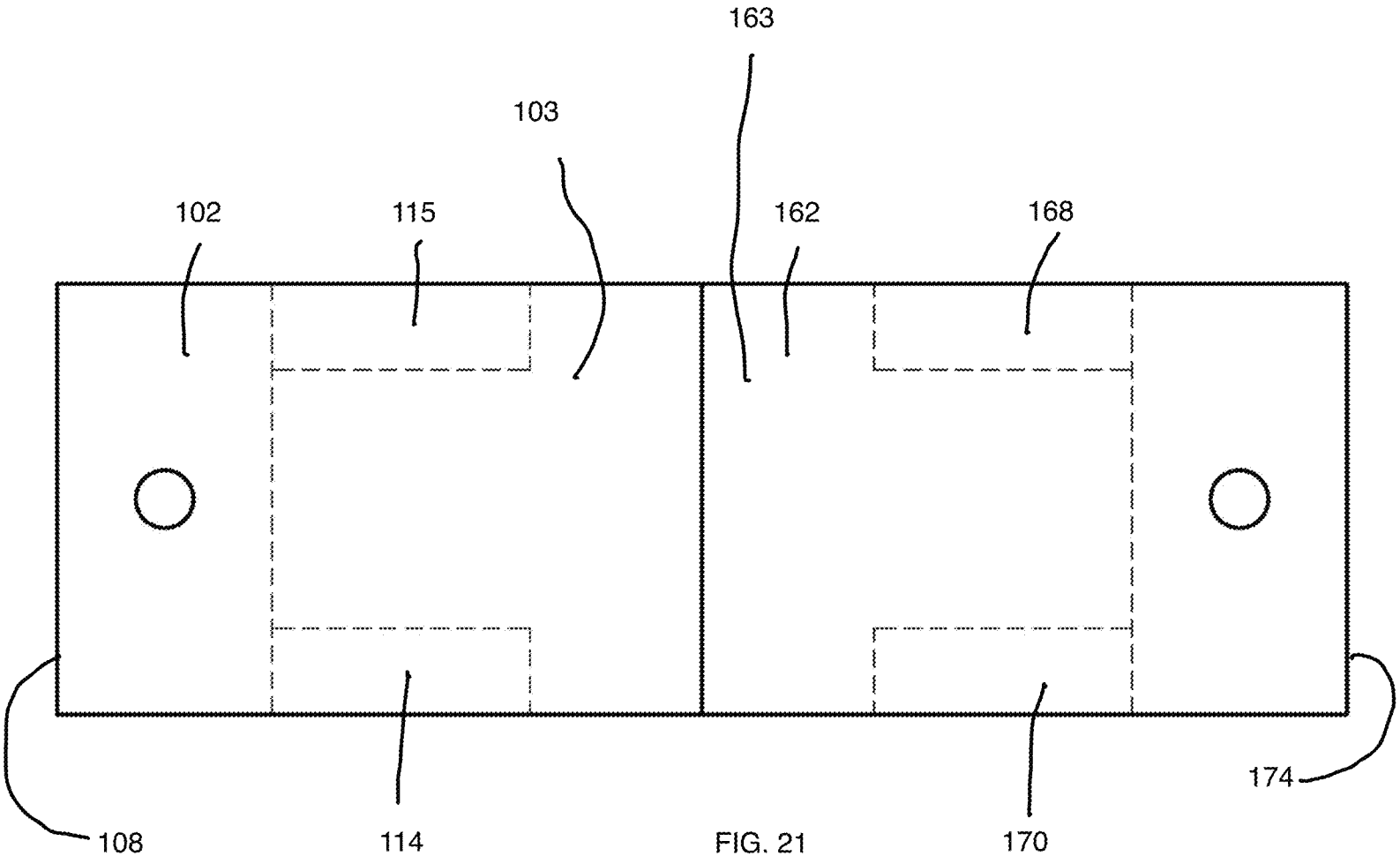
FIG. 21 is a top view thereof.

FIG. 21 shows the top view of the front blocking body 102 and the rear blocking body 162. The legs 114, 115 extend underneath the curved front wall 103. Legs 168, 170 extend underneath the curved rear wall 163. The legs 114, 115 extend rearward from the front lip 108 of the front blocking body 102 toward the attachment aperture to form the base. In one embodiment, the legs 114, 115 stop prior to reaching the attachment aperture. The legs 168, 170 extend forward from the rear end 174 of the rear blocking body 162 toward the attachment tongue to form the base. In one embodiment, the legs 168, 170 stop prior to reaching the attachment tongue.

Figure 22:
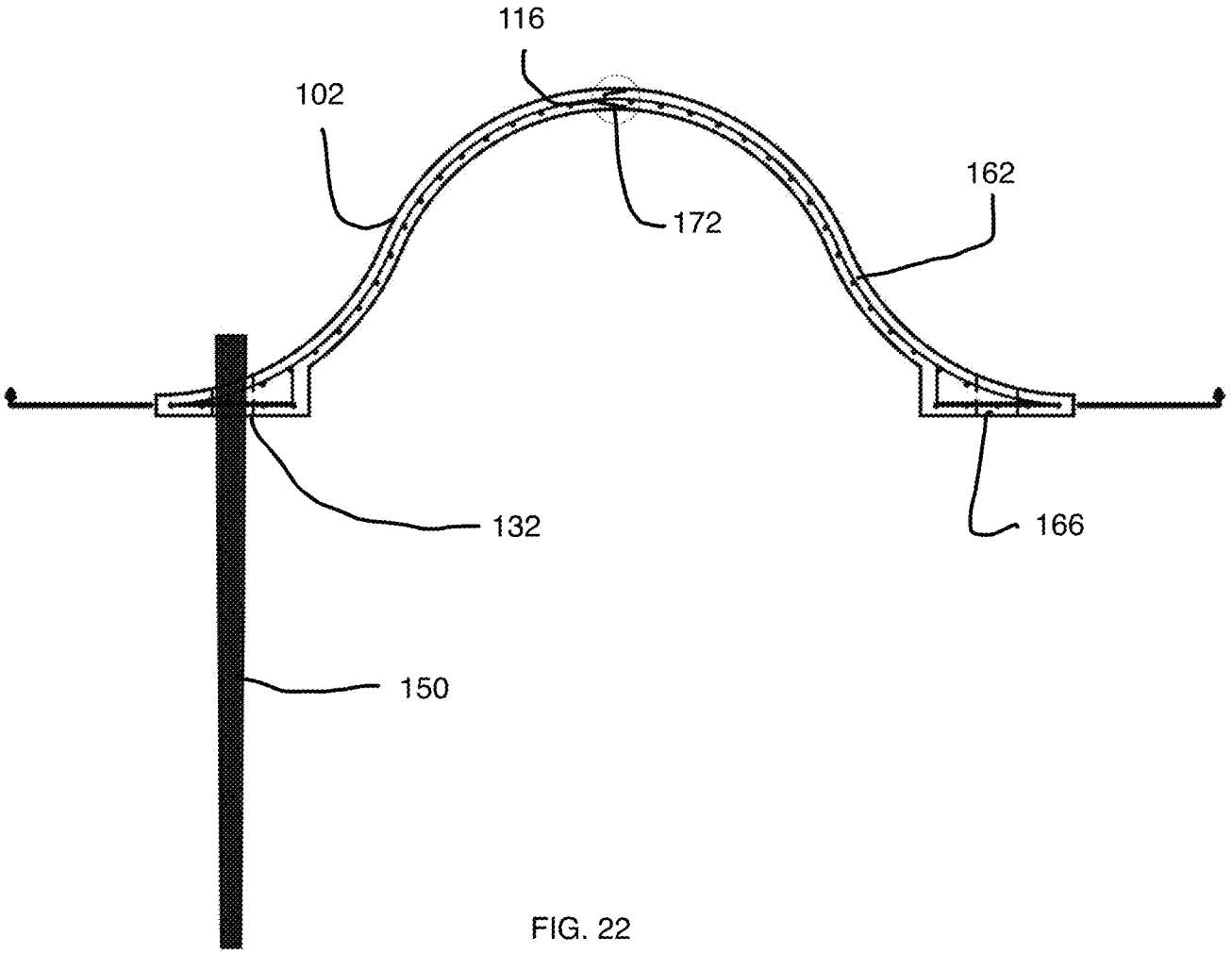
FIG. 22 is a sectional view thereof.

FIG. 22 shows the attachment of front blocking body 102 to the rear blocking body 162 at the attachment at attachment aperture 116 and attachment tongue 172. A pile 150, such as wooden pile is inserted into the anchor aperture 132 of front blocking body 102. A pile may also be inserted into the anchor aperture 166 of rear blocking body 162.

Figures 23, 24:
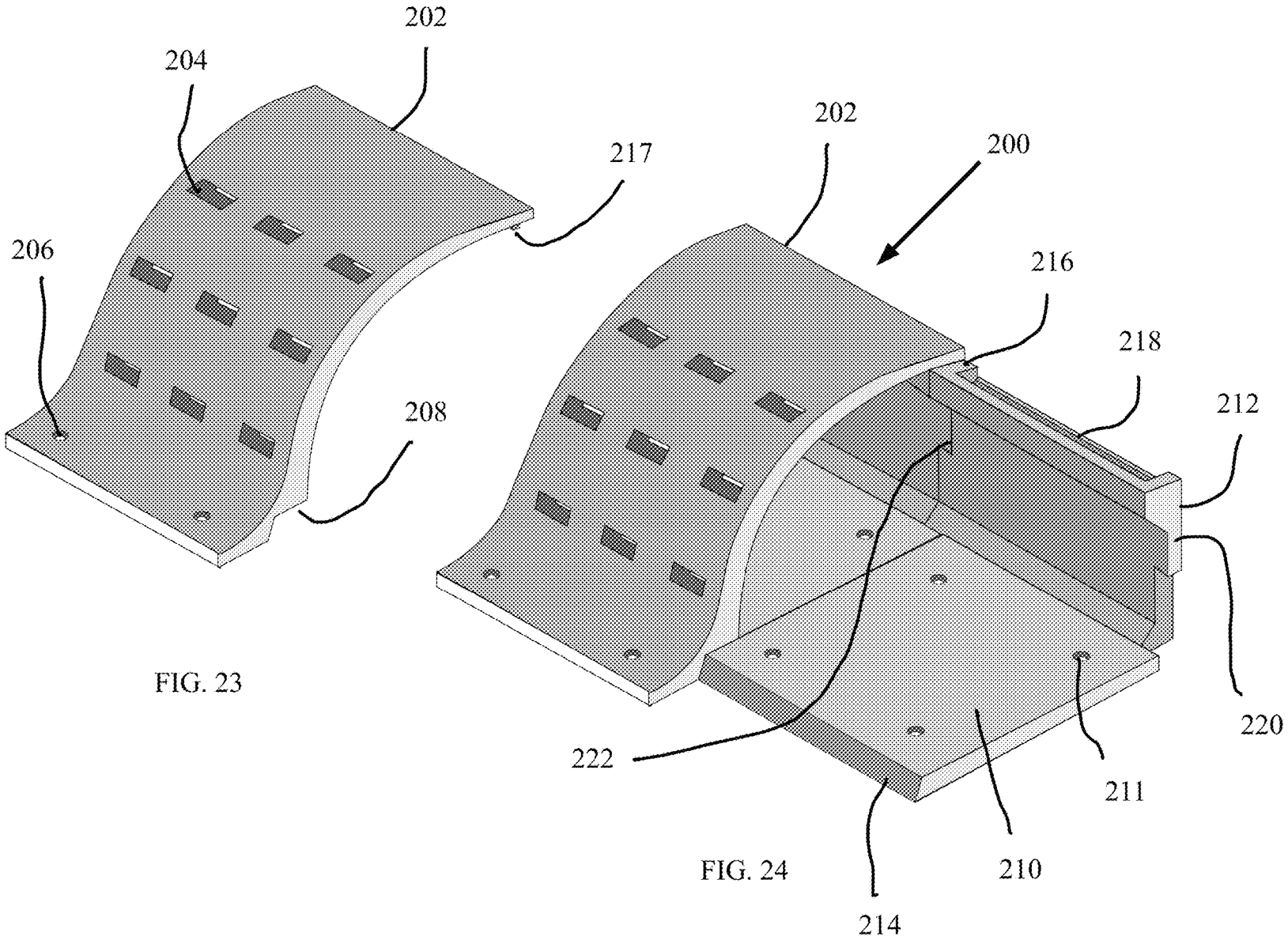
FIG. 23 is a top perspective view of a front wall of one embodiment of the present invention.
FIG. 24 is a top perspective view of one embodiment of the present invention.

FIGS. 23 and 24 show sea wall 200 having a front wall 202, support 212, and base 210. Front wall 202, such as a front blocking wall, rests on base 210 with the front wall 202 placed in front of the base 210. Support 212 contacts the rear of base 210 for securing the base between the front wall 202 and the support 212.

Front wall 202 is curved similar to the front wall described above. Front wall 202 curves along a longitudinal axis. The front wall 202 provides apertures 204 to allow water to flow through the front wall 202. The front wall also provides anchor apertures 206 for accepting a pile to secure the front wall 202 in place. Front wall 202 also provides mating tongue 217 extending downwards to secure the front wall 202 with the support 212.

Referring to FIG. 24, the front wall 202 secures on top of the support 212 and base 210. Support 212 is positioned first. The base 210 is then placed adjacent the support 212. Base 210 is positioned longitudinally in front of support 212. Piles insert into anchor apertures 211 to secure the base 212 to the sea floor. Front wall 202 is then placed on top of the base 210 and the support 212. Front wall 202 is positioned longitudinally in front of the base 210.

Mating lip 217 inserts into mating aperture 218 on the top 216 of support 212. Mating lip 217 is located at or near the rear of front wall 202 near a longitudinal end. Attachment joint 208 mates with base front 214. The attachment joint 208 rests on top of base front 214 to secure the base 210.

Support 212 forms a rear wall for the embodiment shown in FIG. 24. Support 212 provides mating aperture 218 for securing front wall 202. Mating lip 217 inserts into mating aperture 218. Support 212 supports the rear, such as a longitudinal end, of front wall 202.

The sea wall system extends laterally across the shoreline. Adjacent supports 212 mate laterally to extend protection of the sea wall system laterally. Mating finger 220 mates with the adjacent mating joint 222 of the adjacent support 212. The mating finger 220 and mating joint 222 of the supports 212 enable lateral attachment of the supports for installation of multiple sea walls and front walls 202 across the shoreline.

Figure 25:
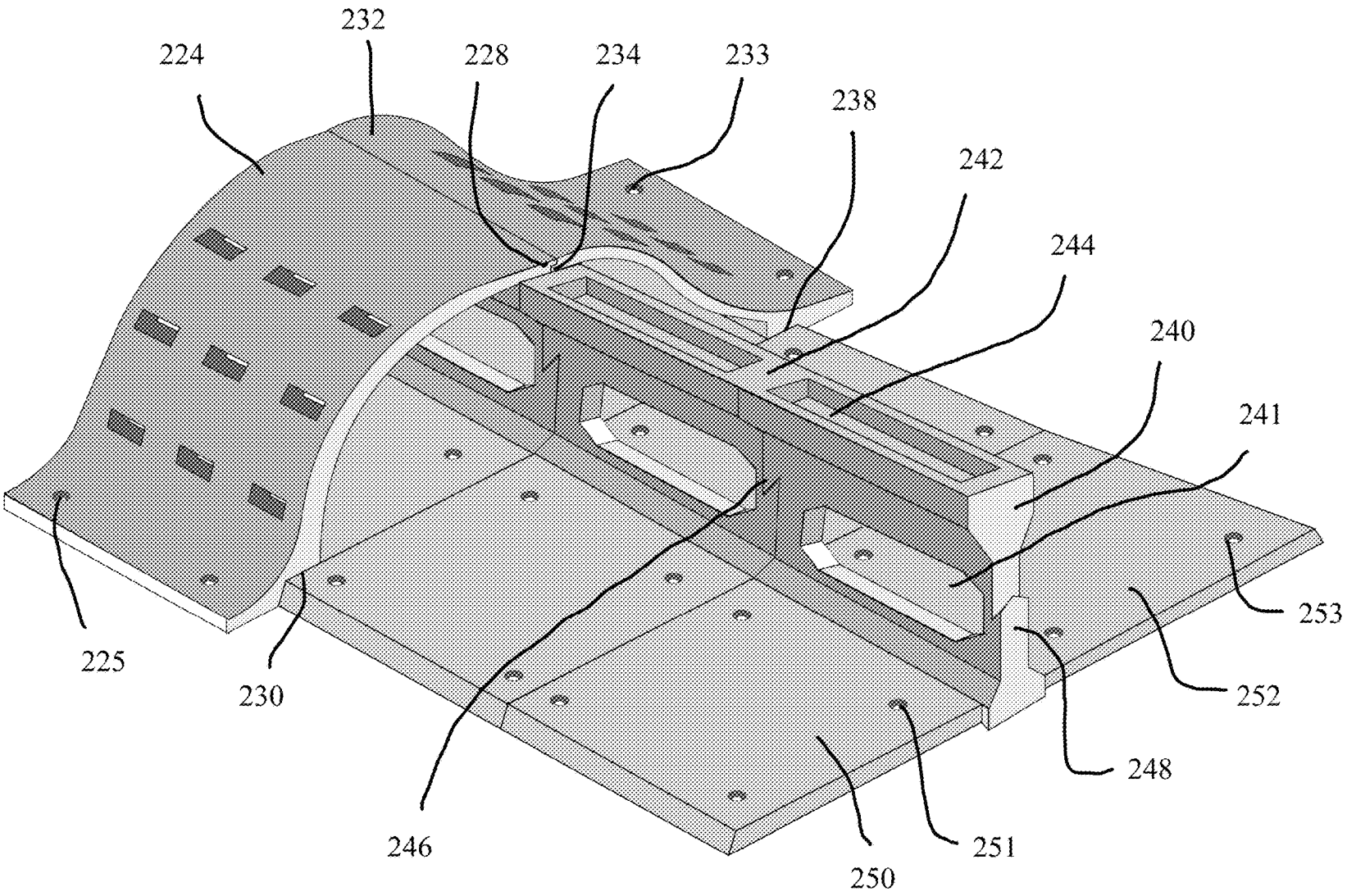
FIG. 25 is a top perspective view of one embodiment of the present invention.
Figure 26:
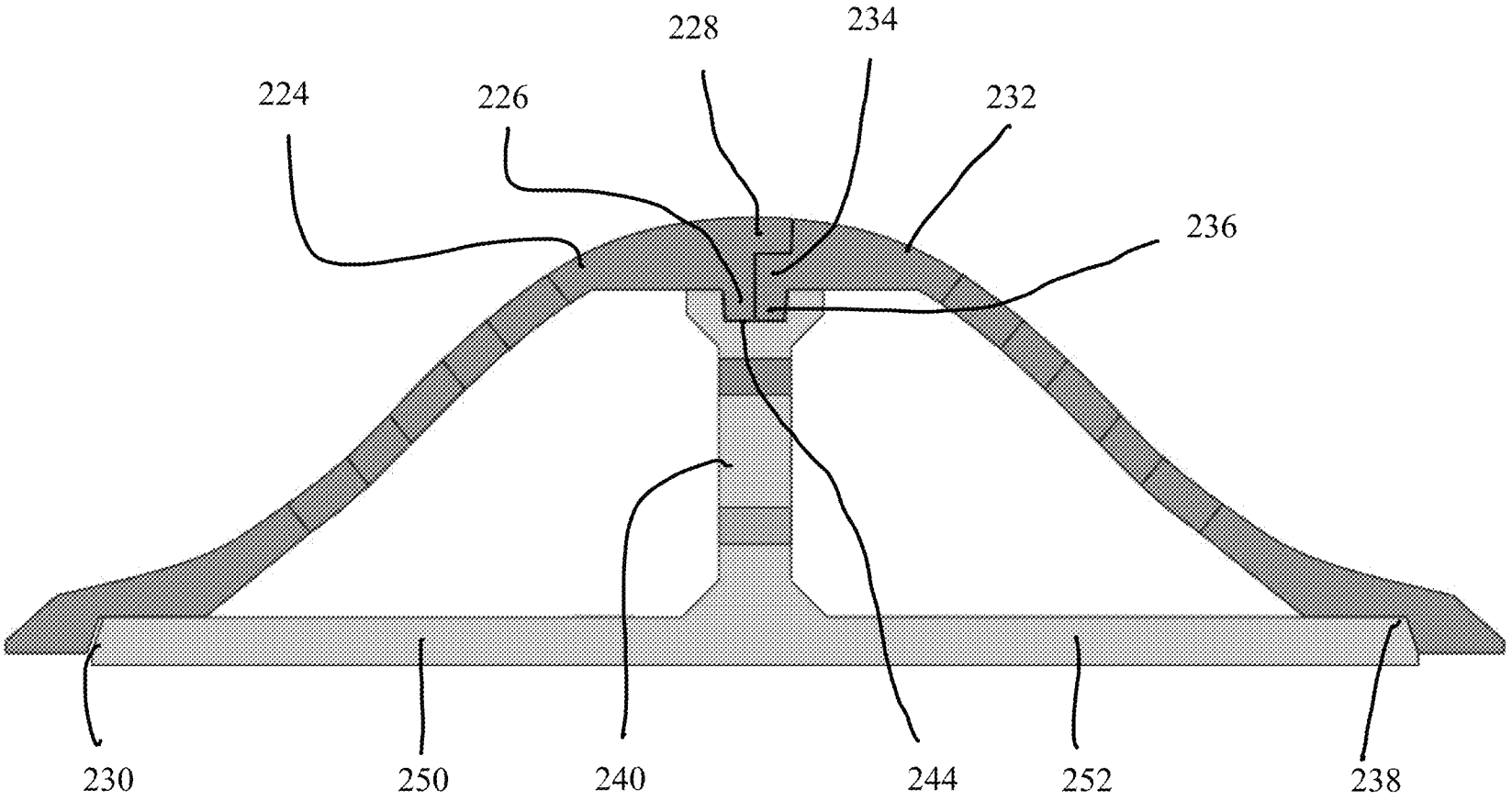
FIG. 26 is a sectional view thereof.
Figure 27:
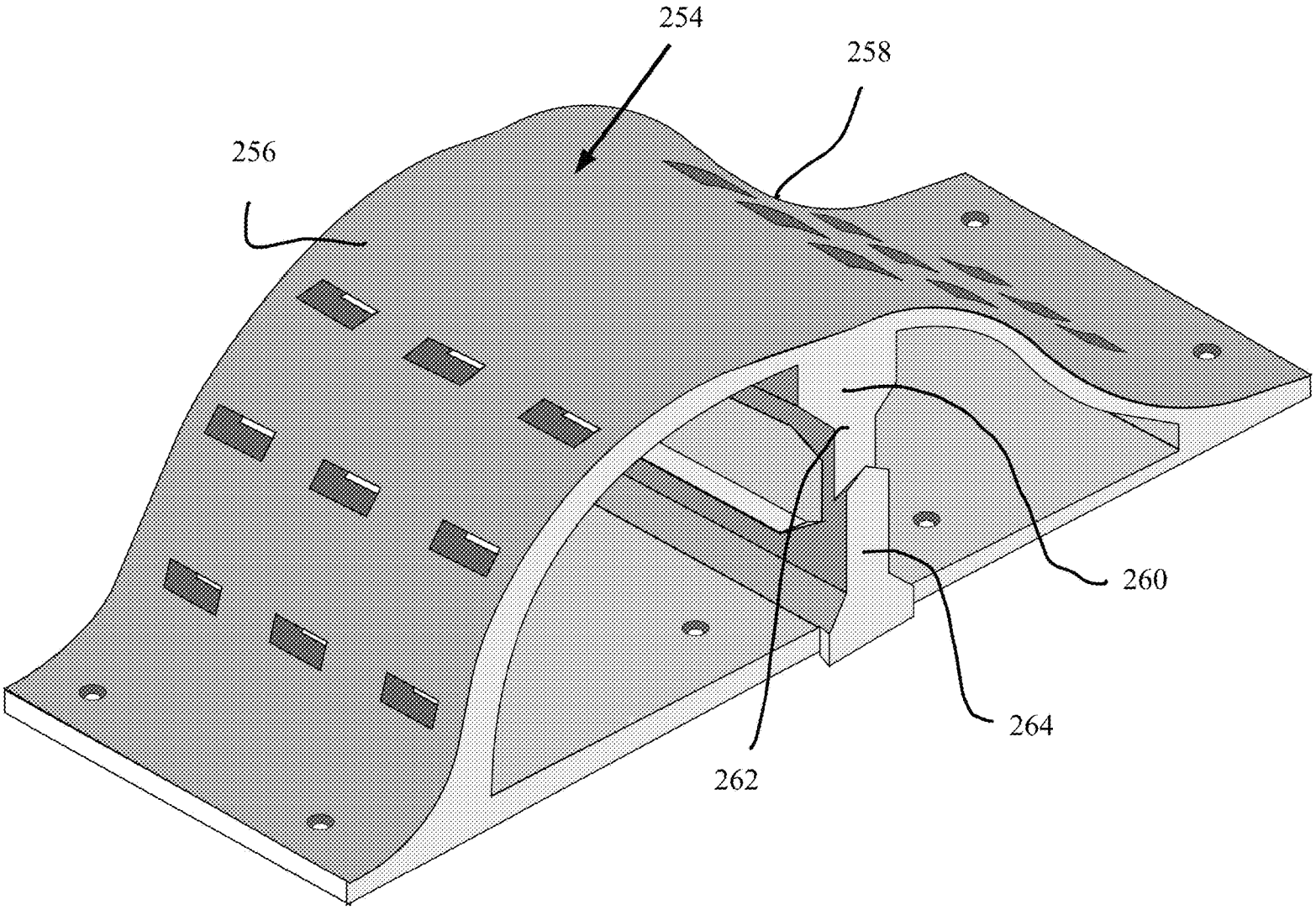
FIG. 27 is a top perspective view of one embodiment of the present invention.

FIGS. 25 and 26 show another embodiment with support 240 supporting front blocking wall 224 and rear blocking wall 232. Blocking walls 224, 232 form a front wall and a rear wall. Each blocking wall 224, 232 provides a mating lip 226, 236 that inserts into mating aperture 244 at the top 242 of support 240. Bases 250, 252 are installed around support 240. Base 250 is installed longitudinally in front of support 240. Base 252 is installed longitudinally behind support 240. Anchor apertures 225, 233, 251, 253 accept piles to anchor the blocking walls 224, 232 and bases 250, 252.

The curve of the blocking walls 224, 232 match each other. The blocking walls curve along the longitudinal axis. The blocking walls 224, 232 attach to each other at the highest point of the curve formed by the blocking walls 224, 232. Each blocking wall 224, 232 provides a lower mating joint 230, 238 that installs over a longitudinal end of bases 250, 252.

The blocking walls 224, 232 connect at an upper mating joint 228, 234. The upper mating joint 228, 234 is the highest point of the curve formed by the blocking walls 224, 232. One blocking wall 224 secures over the other blocking wall 232. The positioning of the blocking walls 224, 232 may interchange. Blocking wall 224, the overlapping wall, may be positioned in the front or the rear.

The supports 240 secure laterally together to increase the width of the sea wall. Securing additional supports 240 laterally provide support for installing additional blocking walls 224, 232 laterally along the shoreline.

Figure 28:
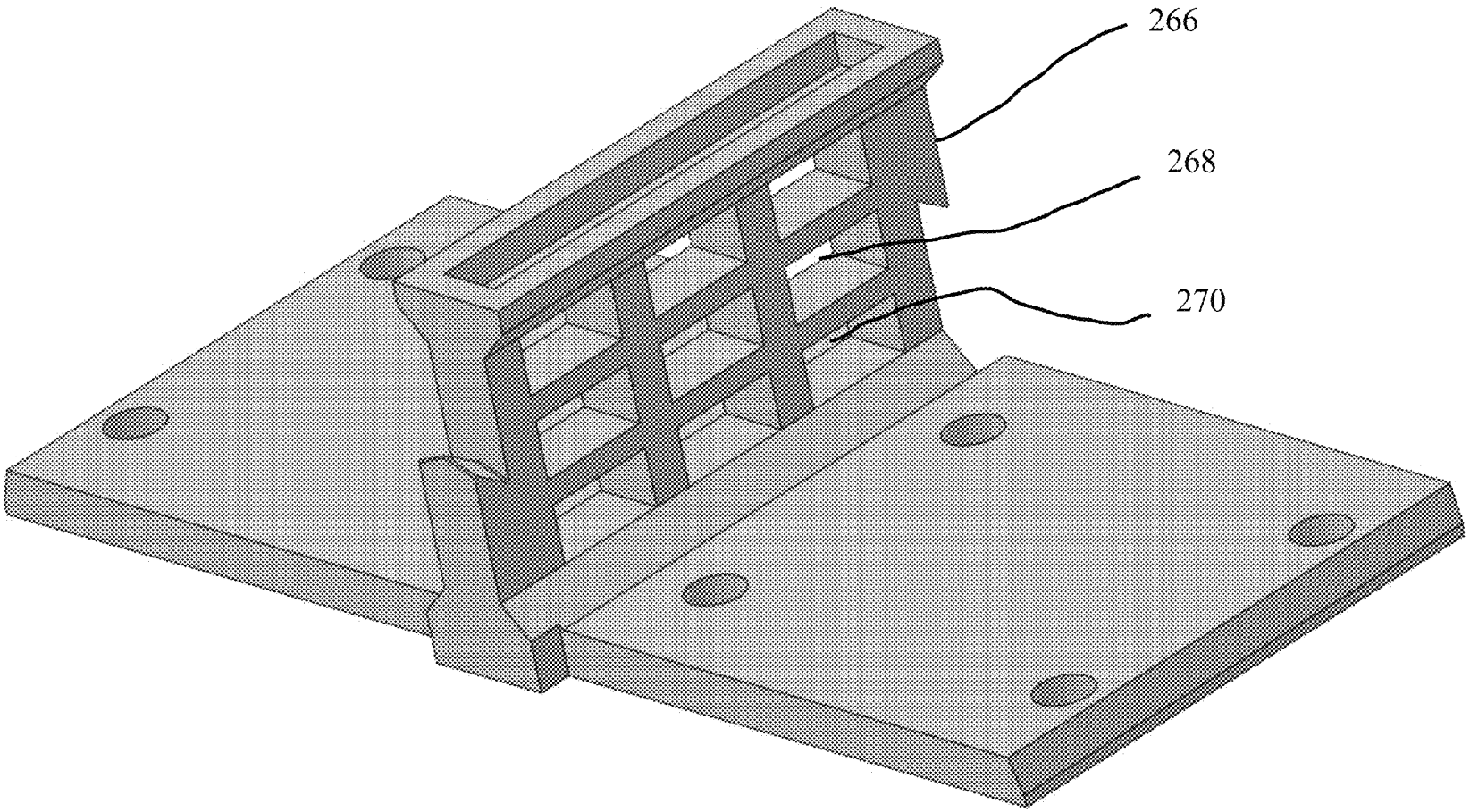
FIG. 28 is a top perspective view of a support and bases of one embodiment of the present invention.

FIG. 28 shows sea wall 254 constructed from a unitary piece with a curved front wall and a curved rear wall. The unitary sea wall may also have a curved front wall and a vertical rear wall shaped similar to FIG. 24 constructed from a single piece. The unitary sea wall construction includes at least a front wall, base, and a support. Another embodiment also includes the curved rear wall.

Sea wall 254 provides front blocking wall 256 and rear blocking wall 258. The blocking walls 256, 258 provide apertures that align with each other to flow through the blocking walls 256, 258. Support 260 supports the front blocking wall 256 and rear blocking wall 258.

Sea wall 254 also provides a base extending from the support 260 the front blocking wall 256 and the rear blocking wall 258. The base is also secured with the support 260 and the blocking walls 256, 258 as a unitary piece. The base and blocking walls 256, 258 proving anchor apertures for securing the sea wall 254 to the floor.

Figure 29:
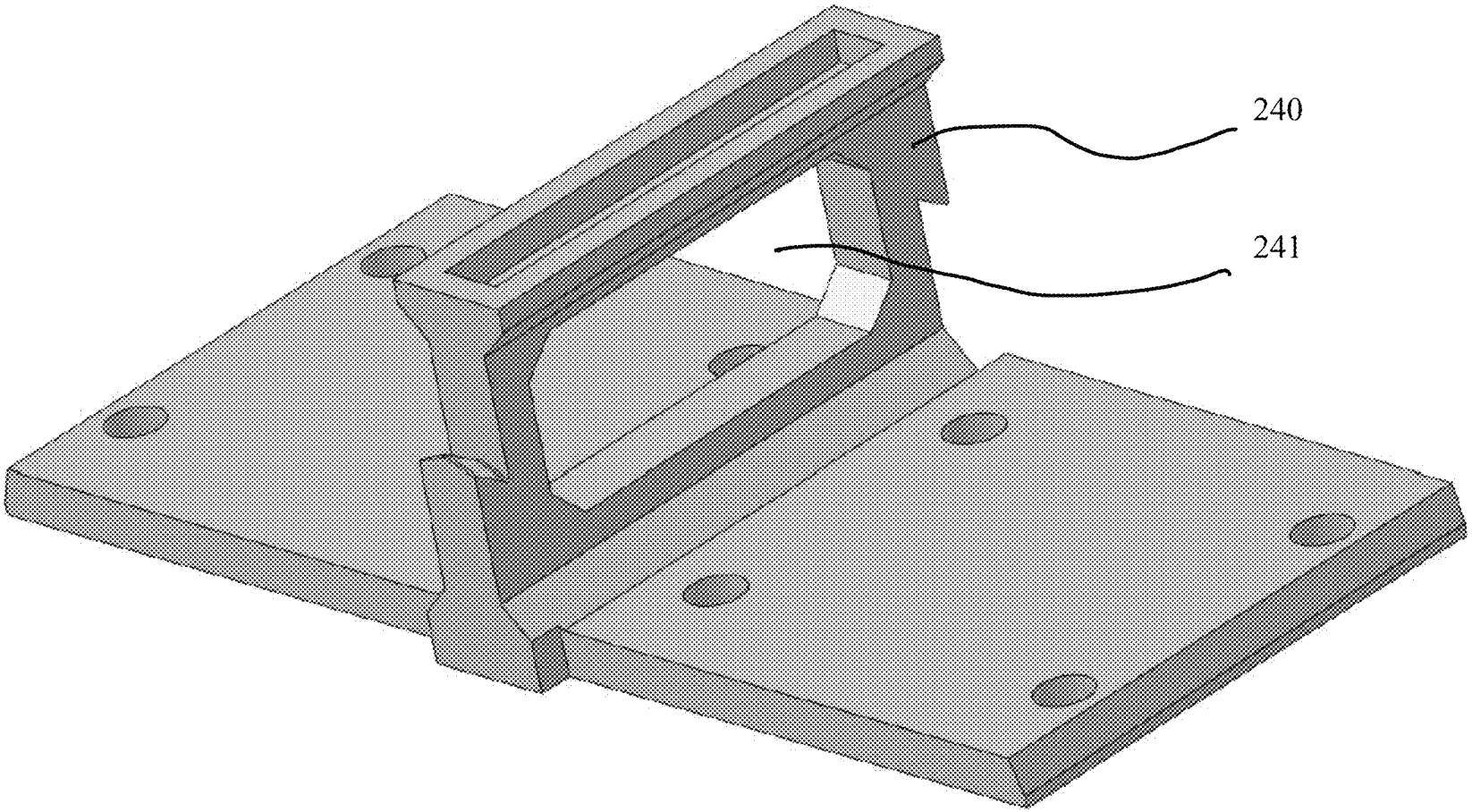
FIG. 29 is a top perspective view of a support and bases of one embodiment of the present invention.
Figure 30:
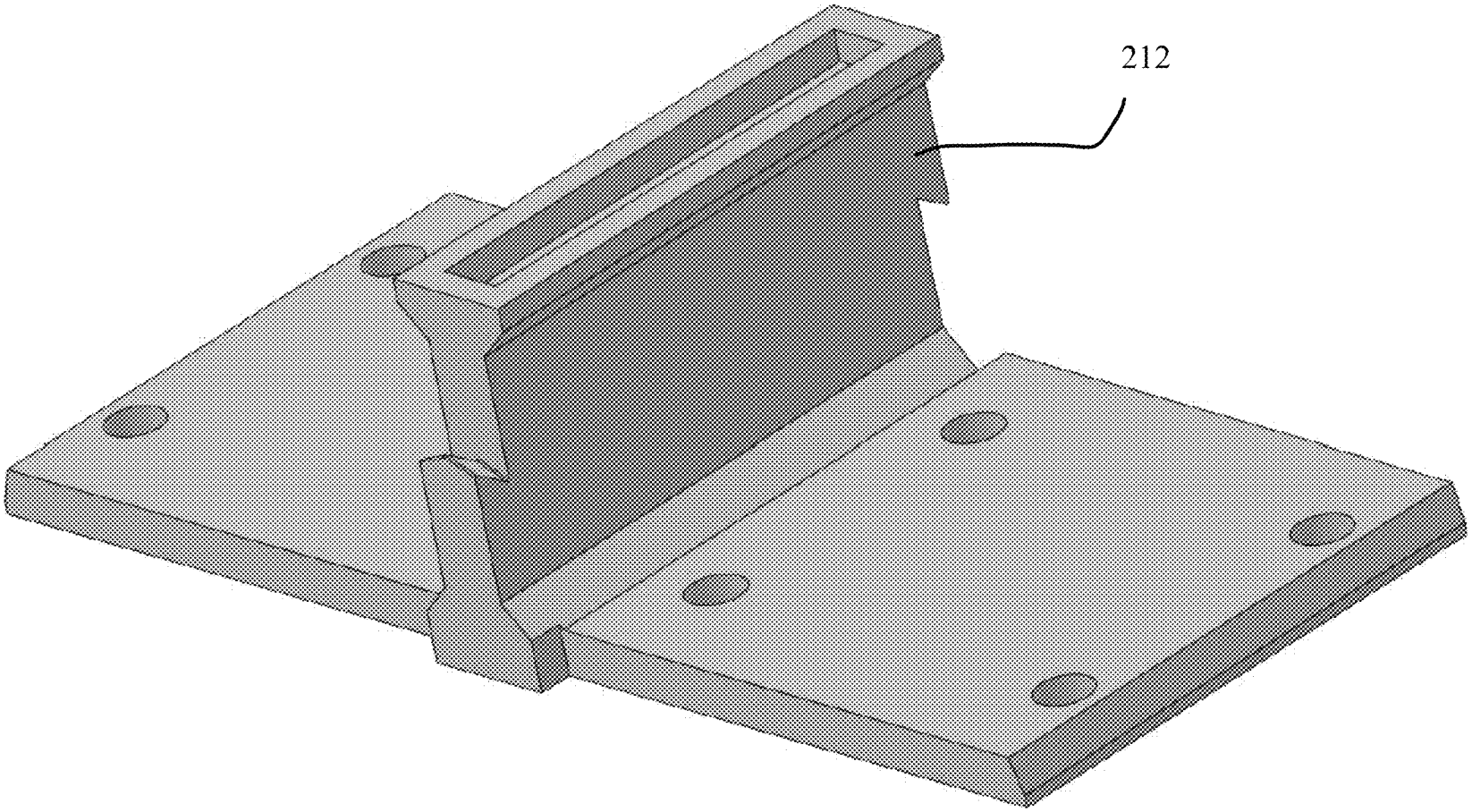
FIG. 30 is a top perspective view of a support and bases of one embodiment of the present invention.

FIGS. 28-30 show different embodiments of supports that vary the flow of water through the support. Support 266 shown in FIG. 28 provides multiple apertures 268, 270 allowing water to pass through the front wall, support, and the rear wall. Support 240 shown in FIG. 29 provides aperture 241 passing through the support 240. Support 212 shown in FIG. 30 provides no aperture passing through the support 212.

The supports 266, 212, 240 of the modular sea wall system are interchangeable for installation in different environments. A curved front wall with the support serving as the rear wall may be installed with any of the supports 266, 212, 240 with the varying apertures or no apertures. A curved front wall and a curved rear wall may be installed with any of the supports 266, 212, 240 with the varying apertures or no apertures. Supports 266, 212, 240 may also be installed on the unitary sea wall 254 to vary the amount of water flowing through support 260.

Sea wall 254 also attaches laterally to adjacent sea walls 254 at the support 260 similar to the sea walls described above. Mating joints 262, 264 located at the lateral ends of adjacent supports 260 of sea walls 254 mate to secure the adjacent sea walls together. The mating joints 262, 264 secure adjacent sea walls 254 to increase lateral coverage of the sea wall system along the shore. The adjacent mating joints are reversed on each side for mating with the adjacent support as shown in FIGS. 24 and 25.

The curved blocking bodies are shown as having the same curvature. In one embodiment, the curvature of the blocking bodies mirror each other. In another embodiment, the rear blocking body may form a vertical wall. In one embodiment, the vertical wall rises at a 90 degree angle in relation to the front blocking body.

The front blocking body and the rear blocking body have a curved wall providing apertures within the curved wall. In one embodiment, the configuration of the apertures in the front and rear blocking bodies align. In one embodiment, the vertical wall version of the real blocking body provides no apertures.

The blocking bodies, blocking walls, base(s), and supports of one embodiment are constructed from reinforced concrete. The reinforced concrete may be reinforced with rebar, fiberglass, welded wire mesh, or other reinforced materials. The wire mesh, L-bars, rebar, fiberglass or other reinforced materials are embedded within the concrete prior to the concrete curing. The reinforced concrete strengthens the structure of the sea wall.

The front blocking body and rear blocking body have been described as contacting at only the attachment point located vertically above the bases. In another embodiment, the bases of the front blocking body and rear blocking may contact each other. In one embodiment, the bases of the front blocking body and the rear blocking body may be secured to each other via tongue and groove, fasteners, brackets, braces, joints, frictional engagements, and other attachments. In one embodiment, the support legs of the front blocking body attach to the support leg(s) of the rear blocking body. The bases and support legs may secure to each other if the rear wall is curved or vertical without curving.

From the foregoing, it will be seen that the present invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A modular sea wall system installed on a floor in a body of water for reducing energy of an incoming wave against a shoreline, the system comprising:

a front blocking wall curving rearward along a longitudinal axis;

a support extending vertically upward, wherein the front blocking wall extends longitudinally rearward to the support;

a base extending longitudinally between the front blocking wall and the support, wherein the front blocking wall is located vertically above the base;

a first lateral side that extends longitudinally with the base;

a second lateral side that extends longitudinally with the base;

an attachment finger extending laterally outward from the first lateral side;

an attachment aperture located on the second lateral side, wherein the attachment aperture is configured to accept an attachment finger of an adjacent sea wall;

wherein the attachment finger is located on the support below an upper surface of the front blocking wall;

wherein the attachment aperture is located on the support below the upper surface of the front blocking wall.

2. The system of claim 1 further comprising:

a top of the attachment finger, wherein the attachment finger extends upward to the top of the attachment finger;

a first longitudinal end and a second longitudinal end of the attachment finger located vertically below the top of the attachment finger, wherein the top of the attachment finger is located longitudinally between the first longitudinal end and the second longitudinal end;

wherein the attachment aperture is shaped to mate with the attachment finger.

3. The system of claim 2 further comprising:

a first lateral end of the attachment finger, wherein the attachment finger joins the support at the first lateral end;

a top of the attachment finger located laterally away from the support and the first lateral end, wherein the attachment finger extends laterally from the support upward to the top, wherein the first lateral end is located vertically below the top;

wherein the attachment aperture is shaped to mate with the attachment finger.

4. The system of claim 1 further comprising:

a first lateral end of the attachment finger, wherein the attachment finger joins the support at the first lateral end;

a top of the attachment finger located laterally away from the support and the first lateral end, wherein the attachment finger extends laterally from the support upward to the top, wherein the first lateral end is located vertically below the top;

wherein the attachment aperture is shaped to mate with the attachment finger.

5. A modular sea wall system installed on a floor in a body of water for reducing energy of an incoming wave against a shoreline, the system comprising:

a front blocking wall curving rearward along a longitudinal axis;

a support extending vertically upward, wherein the front blocking wall extends longitudinally rearward to the support;

a base extending longitudinally between the front blocking wall and the support, wherein the front blocking wall is located vertically above the base;

a mating lip extending vertically downward from the front blocking wall;

a mating aperture on a top of the support, wherein the mating lip inserts into the mating aperture to secure the front blocking wall with support.

6. The system of claim 5, wherein the front blocking wall, the support, and the base are separate components.

7. The system of claim 5, wherein the front blocking wall detaches from the base and the support.

8. The system of claim 5 further comprising:

a mating joint configured for placement of the base under the front blocking body, wherein the front blocking wall rests on the base inserted under the front blocking wall at the mating joint.

9. The system of claim 5 further comprising:

an aperture in the front wall wherein the aperture extends longitudinally through the front wall.

10. The system of claim 5 further comprising:

a rear blocking wall curving rearward along the longitudinal axis, wherein the rear blocking wall secures to the support and extends rearward from the support; wherein the rear blocking wall curves downward from the support.

11. The system of claim 5 further comprising:

a rear blocking wall curving rearward along the longitudinal axis, wherein the rear wall secures to the support and extends rearward from the support; wherein the rear blocking wall curves downward from the support;

a mating lip extending vertically downward from the rear blocking wall;

wherein both the mating lip of the front blocking wall and the mating lip of the rear blocking wall insert into the mating aperture to secure the front blocking wall and the rear blocking wall with the support.

12. The system of claim 11 further comprising:

a front aperture in the front blocking wall, wherein the front aperture extends longitudinally through the front wall;

a rear aperture in the rear blocking wall, wherein the rear aperture in the rear wall extends longitudinally through the rear wall, wherein the rear aperture in the rear blocking wall aligns with the front aperture in the front blocking wall.

13. The system of claim 5, wherein the front blocking body and the rear blocking body are constructed from reinforced concrete.

14. A modular sea wall system installed on a floor in a body of water for reducing energy of an incoming wave against a shoreline, the system comprising:

a front blocking wall curving rearward along a longitudinal axis;

a support extending vertically upward, wherein the front blocking wall extends longitudinally rearward to the support, wherein the front blocking wall attaches at a top of the support;

a front base extending longitudinally between the front blocking wall and the support, wherein the front blocking wall is located vertically above the front base;

a rear blocking wall curving rearward along the longitudinal axis, wherein the rear wall secures at the top of the support and extends rearward from the support; wherein the rear blocking wall curves downward from the support;

a rear base extending longitudinally between the support and the rear blocking wall, wherein the rear blocking wall is located vertically above the rear base;

a mating lip extending vertically downward from the front blocking wall;

a mating lip extending vertically downward from the rear blocking wall;

a mating aperture on the top of the support, wherein both the mating lip of the front blocking wall and the mating lip of the rear blocking wall insert into the mating aperture to secure the front blocking wall and the rear blocking wall with the support.

15. The system of claim 14 further comprising:

a wave pattern formed by an upper surface of the front blocking wall and the rear blocking wall;

a crest of the wave pattern of the front wall located where the front blocking wall joins the rear blocking wall;

a trough of the wave pattern of the front wall located at a front of the front blocking wall and a rear of the rear blocking wall.

16. The system of claim 14, wherein the front blocking body, the rear blocking body, the support, the front base, and the rear base are a unitary piece.

17. The system of claim 14, wherein the front blocking wall, the rear blocking wall, the support, the front base, and the rear base are separate components.

18. The system of claim 14, wherein the support extends vertically downward from the attachment aperture without curving.

19. The system of claim 14, where the front blocking wall and the rear blocking wall detach from the support.

20. A modular sea wall system installed on a floor in a body of water for reducing energy of an incoming wave against a shoreline, the system comprising:

a front blocking wall curving rearward along a longitudinal axis;

a support extending vertically upward without curving, wherein the front blocking wall extends longitudinally rearward to a mating aperture on a top of the support;

a base extending longitudinally between the front blocking wall and the support, wherein the front blocking wall is located vertically above the base;

a mating lip extending vertically downward from the front blocking wall;

wherein the mating lip inserts into the mating aperture to secure the front blocking wall with support;

a mating joint on a lateral edge of the support, wherein the mating joint is configured to secure to a mating joint of an adjacent support installed adjacent the support.

21. The system of claim 20 further comprising:

a rear blocking wall curving rearward along the longitudinal axis, wherein the rear wall secures to the support at the attachment aperture and extends rearward from the support;

wherein the rear blocking wall curves downward from the support;

a mating lip extending vertically downward from the rear blocking wall;

wherein both the mating lip of the front blocking wall and the mating lip of the rear blocking wall insert into the mating aperture to secure the front blocking wall and the rear blocking wall with the support.

22. The system of claim 21 further comprising:

a mating joint of the front blocking wall; and a mating joint of the rear blocking wall, wherein the mating joint of the front blocking wall mates with the mating joint of the rear blocking wall above the attachment lips of the front blocking wall and the rear blocking wall to secure the front blocking wall with the rear blocking wall.

* * * * *